US011053943B2

(12) United States Patent
Tsugihashi

(10) Patent No.: US 11,053,943 B2
(45) Date of Patent: Jul. 6, 2021

(54) COMPRESSOR UNIT

(71) Applicant: Kobe Steel, Ltd., Hyogo (JP)

(72) Inventor: Kazuki Tsugihashi, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 161 days.

(21) Appl. No.: 15/738,420

(22) PCT Filed: May 30, 2016

(86) PCT No.: PCT/JP2016/065871
§ 371 (c)(1),
(2) Date: Dec. 20, 2017

(87) PCT Pub. No.: WO2017/002500
PCT Pub. Date: Jan. 5, 2017

(65) Prior Publication Data

US 2018/0172006 A1 Jun. 21, 2018

(30) Foreign Application Priority Data

Jun. 29, 2015 (JP) ..... JP2015-129739

(51) Int. Cl.
*F04C 29/06* (2006.01)
*F04D 29/66* (2006.01)
*F04B 39/00* (2006.01)

(52) U.S. Cl.
CPC ..... *F04C 29/066* (2013.01); *F04B 39/0033* (2013.01); *F04C 29/06* (2013.01); *F04D 29/663* (2013.01)

(58) Field of Classification Search
CPC .... F04B 39/00; F04B 39/0033; F04B 53/002; F04B 35/06; F04B 39/0027–0033;
(Continued)

(56) References Cited

U.S. PATENT DOCUMENTS

2014/0161640 A1* 6/2014 Geue ..... F04C 29/066 417/312
2014/0248167 A1 9/2014 Sugimoto et al.
2015/0023811 A1* 1/2015 Yamada et al.

FOREIGN PATENT DOCUMENTS

JP H06-236186 A 8/1994
JP 2007-315215 A 12/2007
(Continued)

OTHER PUBLICATIONS

The extended European search report issued by the European Patent Office dated Nov. 7, 2018, which corresponds to European Patent Application No. 16817609.7-1004 and is related to U.S. Appl. No. 15/738,420.

(Continued)

*Primary Examiner* — Alexander B Comley
(74) *Attorney, Agent, or Firm* — Studebaker & Brackett PC

(57) ABSTRACT

A compressor unit includes a compressor, an electric motor which is lined with the compressor along the horizontal direction and drives the compressor, and a sound shielding member which reduces noise generated by the compressor. The sound shielding member has a shape of surrounding the compressor on a first side, a second side and a third side of the compressor and exposing the electric motor, the first and second sides being in a depth direction perpendicular to a lined direction in which the compressor and the electric motor are lined, and the third side being opposite to another side of the compressor where the electric motor is located in the lined direction.

12 Claims, 33 Drawing Sheets

(58) Field of Classification Search
CPC ..... F04C 29/06; F04C 29/066; F04C 18/16; F04C 18/18; F04C 29/065–066; F04D 29/663
USPC ..... 417/312
See application file for complete search history.

(56) References Cited

FOREIGN PATENT DOCUMENTS

| | | | |
|---|---|---|---|
| JP | 2007315215 | * | 12/2007 |
| JP | 2009-156137 | * | 7/2009 |
| JP | 2009-156137 A | | 7/2009 |

OTHER PUBLICATIONS

PCT/IB/373, International Preliminary Report on Patentability (IPRP), dated Jan. 2, 2018, from parent application No. PCT/JP2016/065871, 1 pp.
PCT/ISA/237, Written Opinion, dated Aug. 30, 2016, from parent appl No. PCT/JP2016/065871, 7 pp.
International Search Report issued in PCT/JP2016/065871; dated Aug. 30, 2016.

* cited by examiner

COMPRESSOR UNIT

TECHNICAL FIELD

The present invention relates to a compressor unit.

BACKGROUND ART

Some conventional compressors are surrounded by a sound shielding member in order to reduce noise generated by the compressor in operation. For example, Patent Literature 1 discloses a compressor unit including a compressor, a motor, and a sound shielding panel. The sound shielding panel includes a tubular side panel circumferentially surrounding the compressor and the motor, and a top panel covering the upper opening of the side panel.

In a compressor unit as described in Patent Literature 1, there has been a need to reduce cost as much as possible while reducing the noise generated by the compressor.

CITATION LIST

Patent Literature

Patent Literature 1: JP H06-236186 A

SUMMARY OF INVENTION

An object of the present invention is to provide a compressor unit capable of achieving both reduction in noise generated by a compressor and reduction in cost.

In order to solve the abovementioned problem, the inventors of the present invention have focused on that the noise generated by the electric motor is smaller in many cases than the noise generated by the compressor and that the electric motor suppresses propagation of the noise generated by the compressor. The inventors have reached to an idea that using the electric motor as a part of the sound shielding structure may effectively reduce the noise generated by the compressor while reducing the amount (cost) of the sound shielding member.

The present invention has been made based on the above-described viewpoint. A compressor unit according to an aspect of the present invention includes a compressor, an electric motor that is disposed to be lined with the compressor alone a horizontal direction and drives the compressor, and a sound shielding member that reduces noise generated by the compressor, wherein the sound shielding member has a shape of surrounding the compressor on a first side, a second side and a third side of the compressor and exposing the electric motor, the first and second sides being in a depth direction perpendicular to a lined direction in which the compressor and the electric motor are lined, and the third side being opposite to another side of the compressor where the electric motor is located in the lined direction.

DESCRIPTION OF EMBODIMENTS

A compressor unit according to an embodiment of the present invention will now be described with reference to FIGS. 1 to 14.

Figure 1:
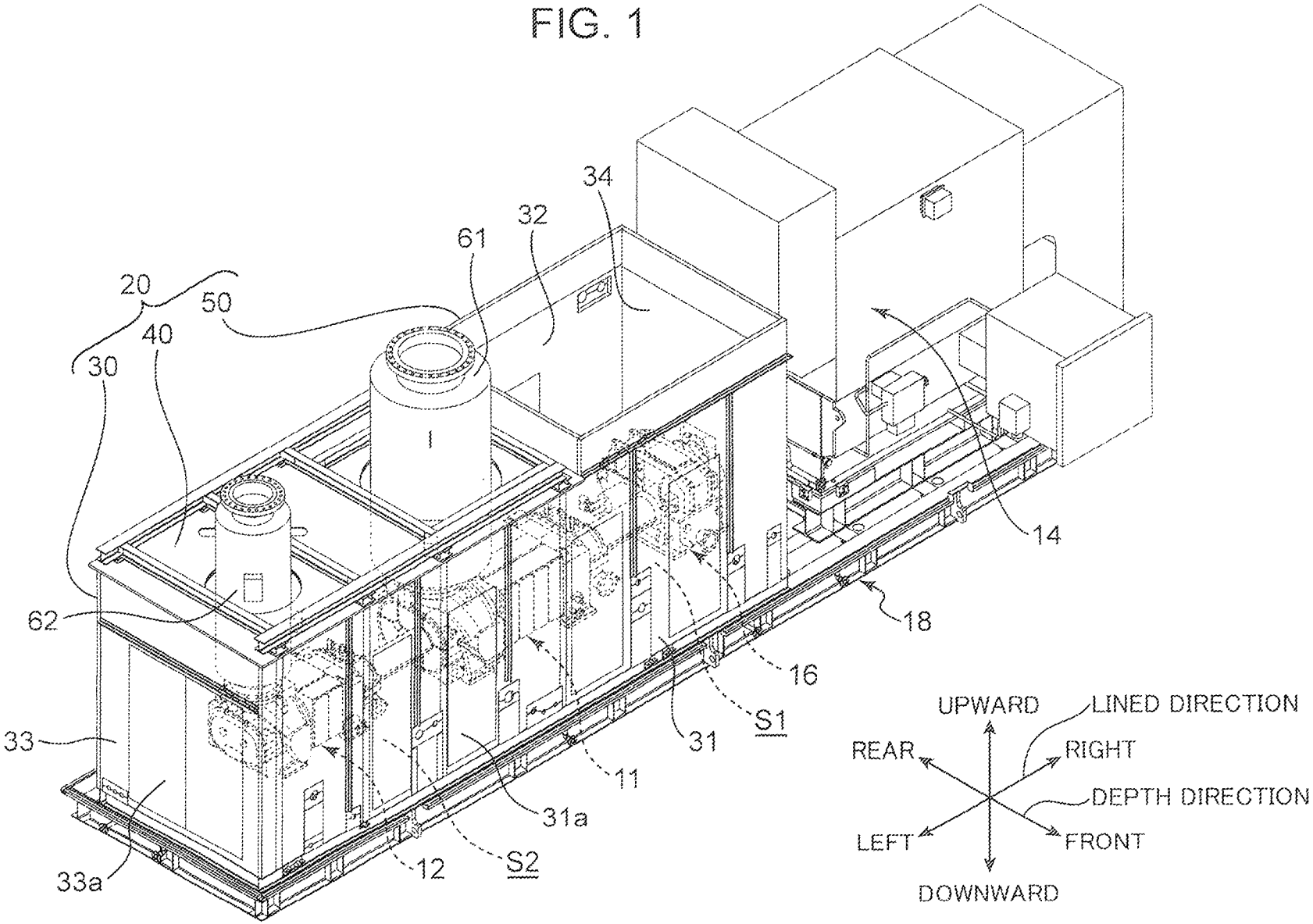
FIG. 1 is a looking-down perspective view illustrating a compressor unit according to an embodiment of the present invention.
Figure 2:
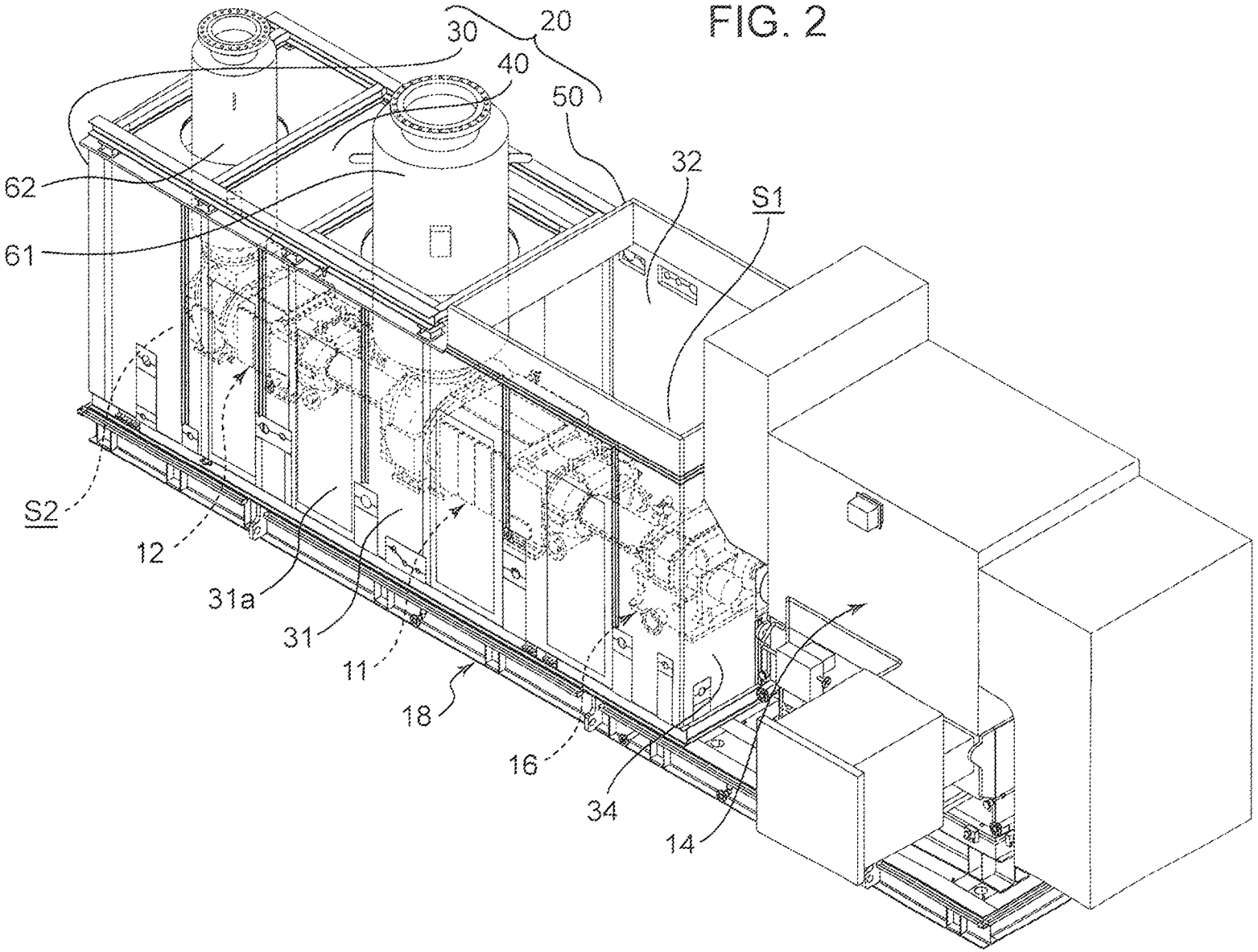
FIG. 2 is a looking-down perspective view illustrating the compressor unit.
Figure 3:
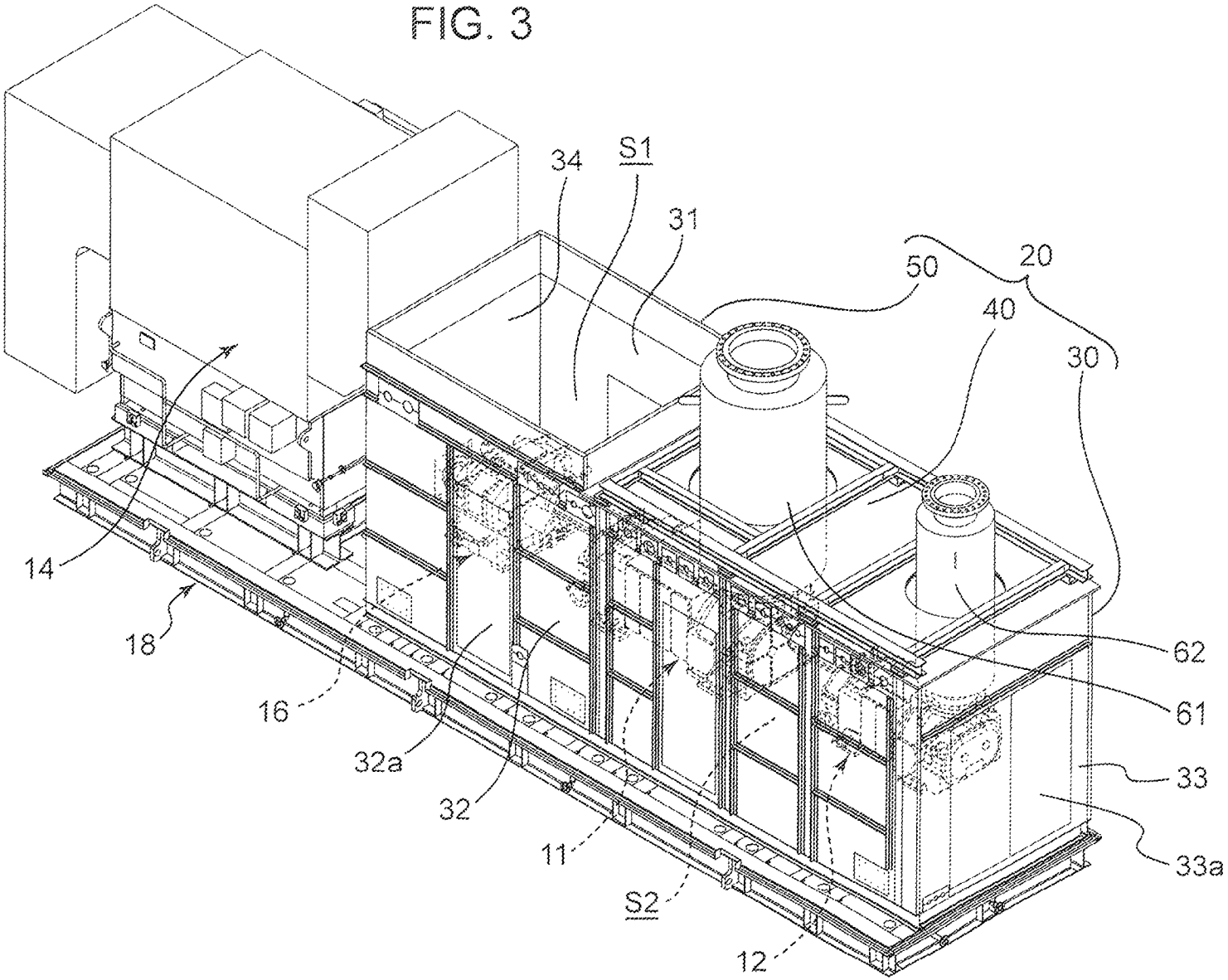
FIG. 3 is a looking-down perspective view illustrating the compressor unit.
Figure 4:
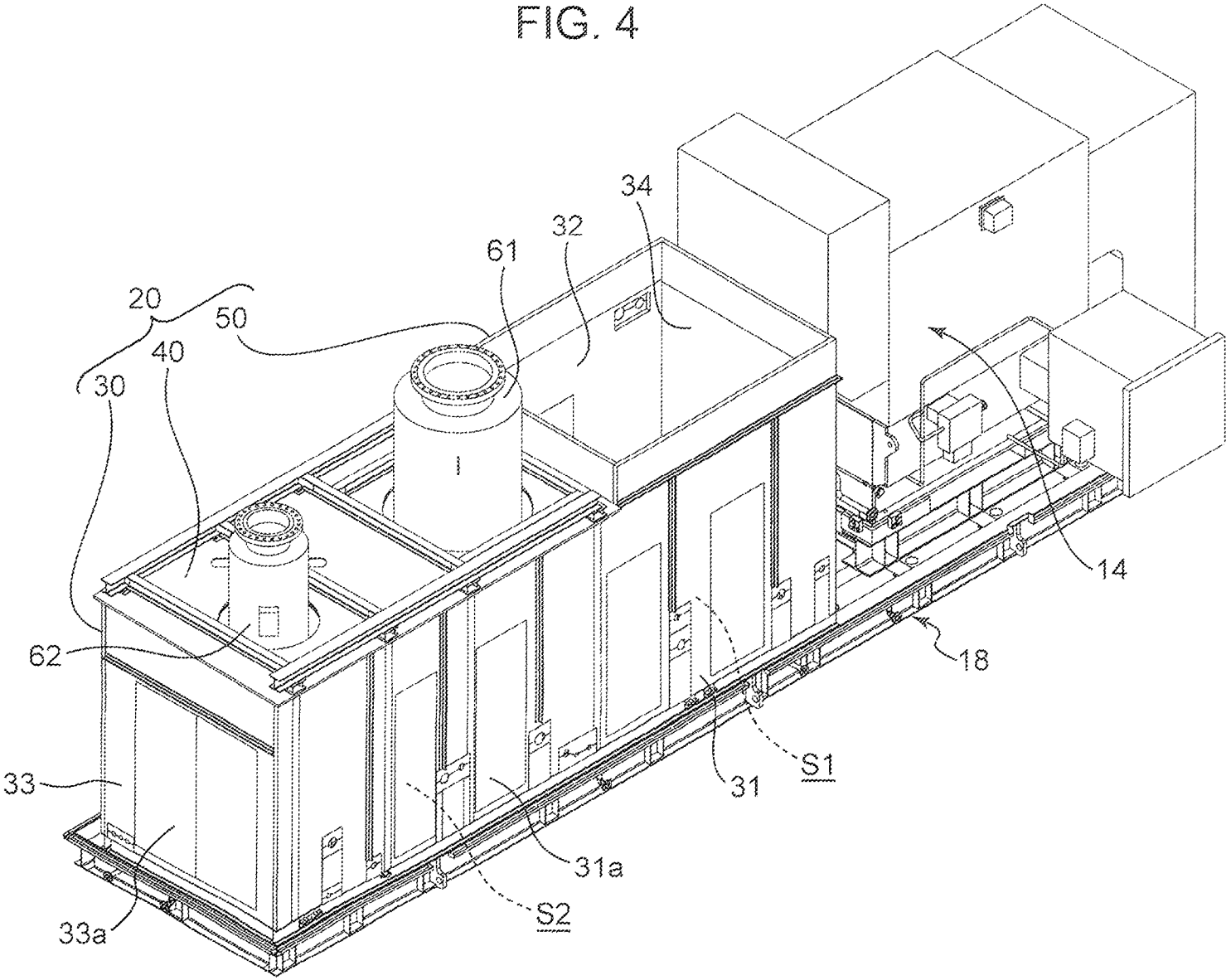
FIG. 4 is a looking-down perspective view illustrating the compressor unit.
Figure 5:
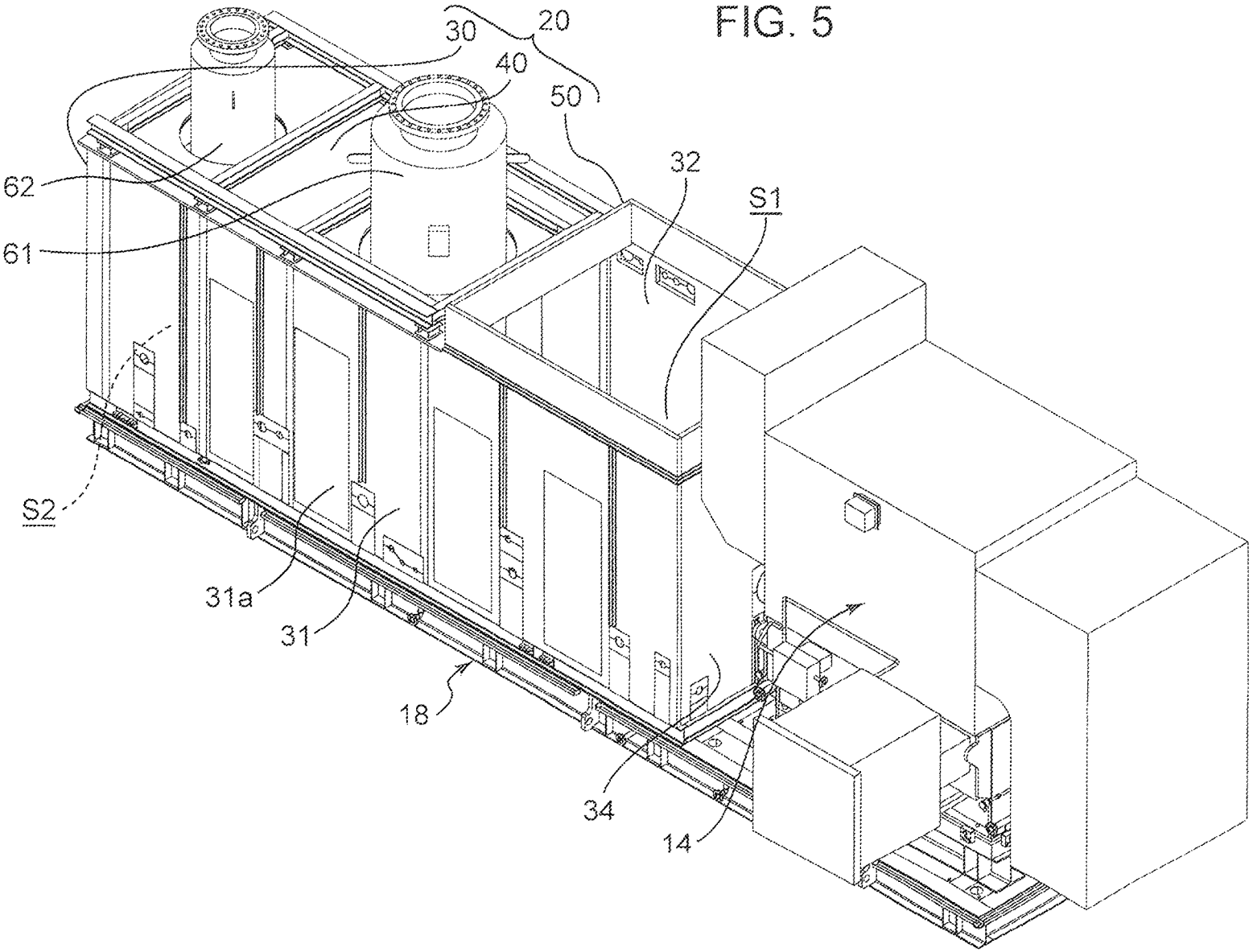
FIG. 5 is a looking-down perspective view illustrating the compressor unit.
Figure 6:
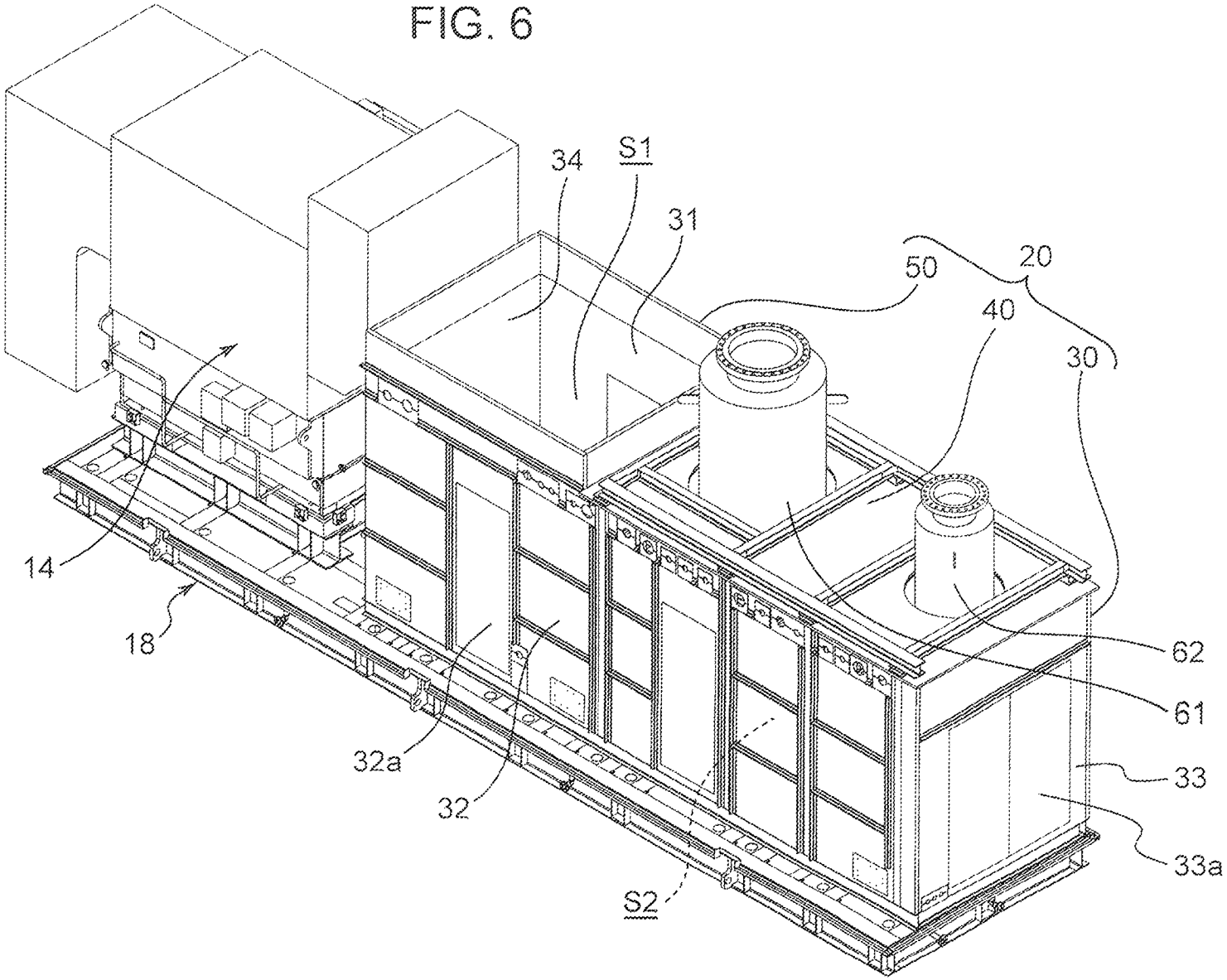
FIG. 6 is a looking-down perspective view illustrating the compressor unit.
Figure 7:
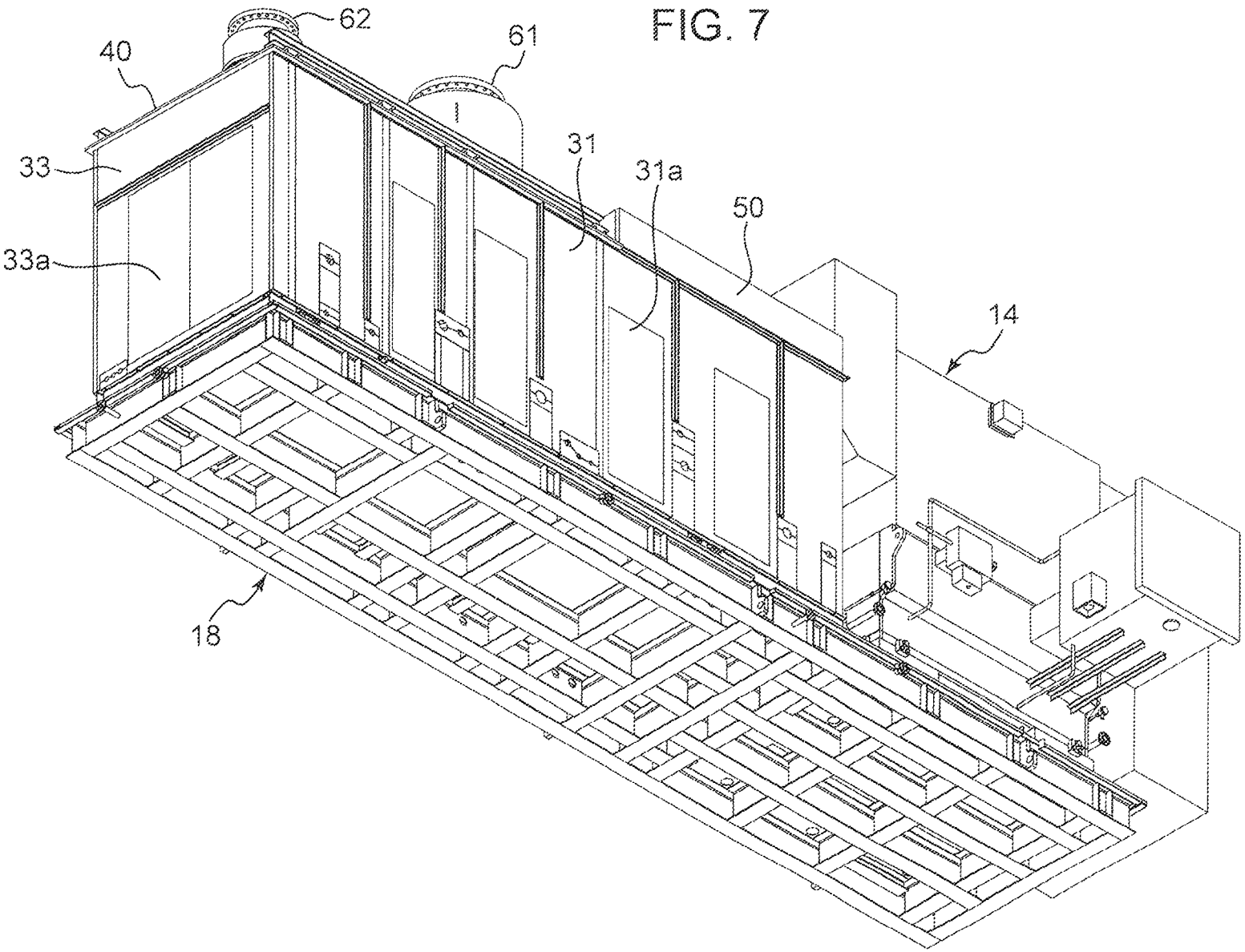
FIG. 7 is a looking-up perspective view illustrating the compressor unit.
Figure 8:
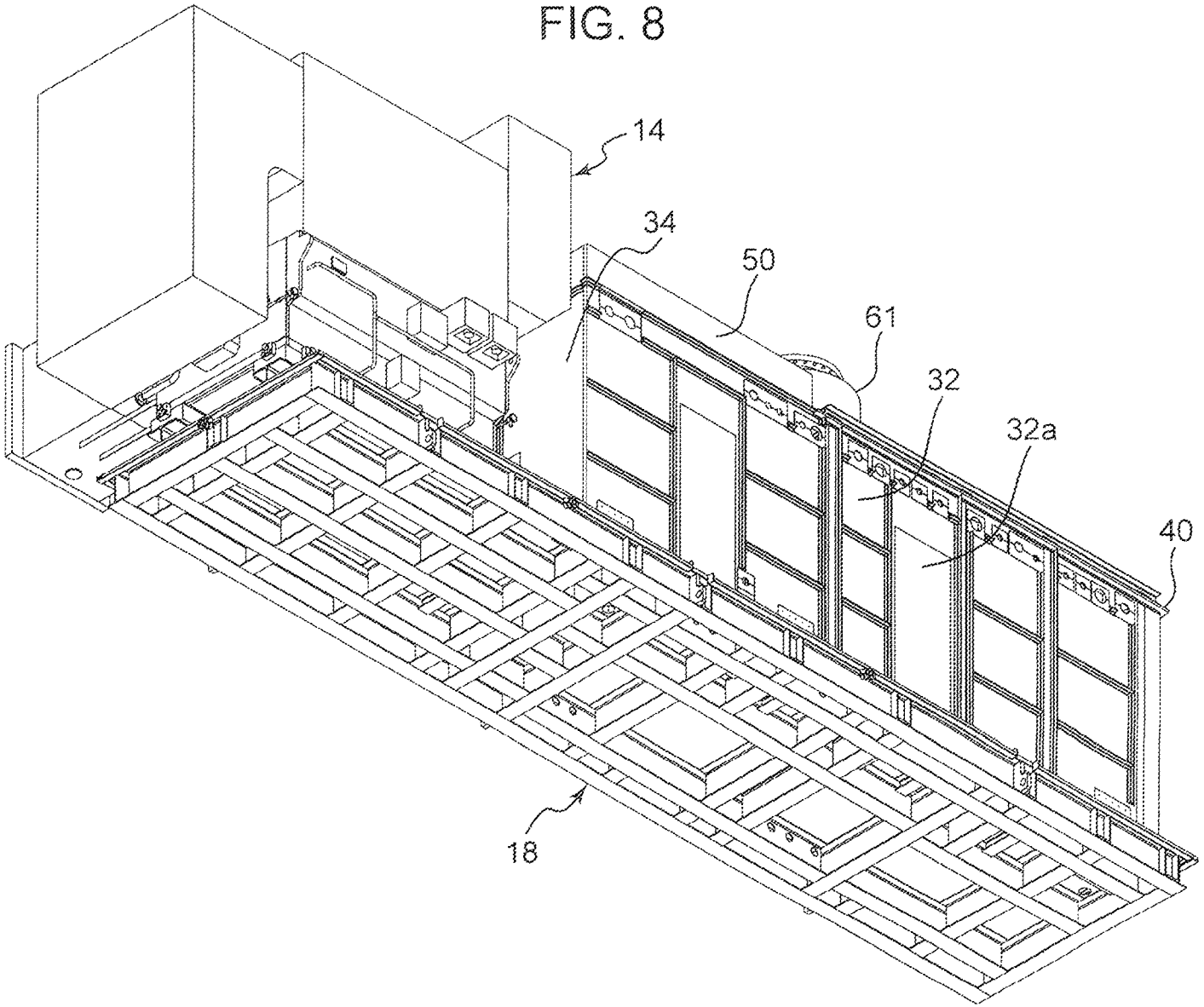
FIG. 8 is a looking-up perspective view illustrating the compressor unit.

As illustrated in FIGS. 1 to 3, the compressor unit includes a first compressor 11, a second compressor 12, an electric motor 14, a gar box 16, and a sound shielding member 20. In the embodiment, the electric motor 14, the gear box 16, the first compressor 11, and the second compressor 12 are disposed in line in this order along the horizontal direction. Hereinafter, as illustrated in FIG. 1, the direction in which the first compressor 11 the second compressor 12, and the electric motor 14 are lined is referred to as lined direction, and the direction perpendicular to both the lined direction and the vertical direction is referred to as depth direction. In the embodiment, the length of the compressor units in the lined direction is larger than the length of the compressor unit in the depth direction. With regard to the depth direction, one of the sides is defined as front side (the left side of the compressors 11 and 12 in a view from the electric motor 14 looking forward) and the other side is defined as rear side.

The first compressor 11 compresses gas. The second compressor 12 further compresses the gas discharged from the first compressor 11. In the embodiment, screw compressors are used as the first compressor 11 and the second compressor 12. Each of the compressors is not necessarily a screw compressor. In the embodiment, the first suction silencer 61 is disposed in the downstream of the first compressor 11, and the second suction silencer 62 is disposed in the downstream of the second compressor 12. The first suction silencer 61 reduces pulsation of the gas suctioned by the first compressor 11, thereby reducing the noise generated by the components disposed in the downstream of the first compressor 11. The second suction silencer 62 reduces pulsation of the gas suctioned by the second compressor 12, thereby reducing the noise generated by the components disposed in the downstream of the second compressor 12.

Figure 13:
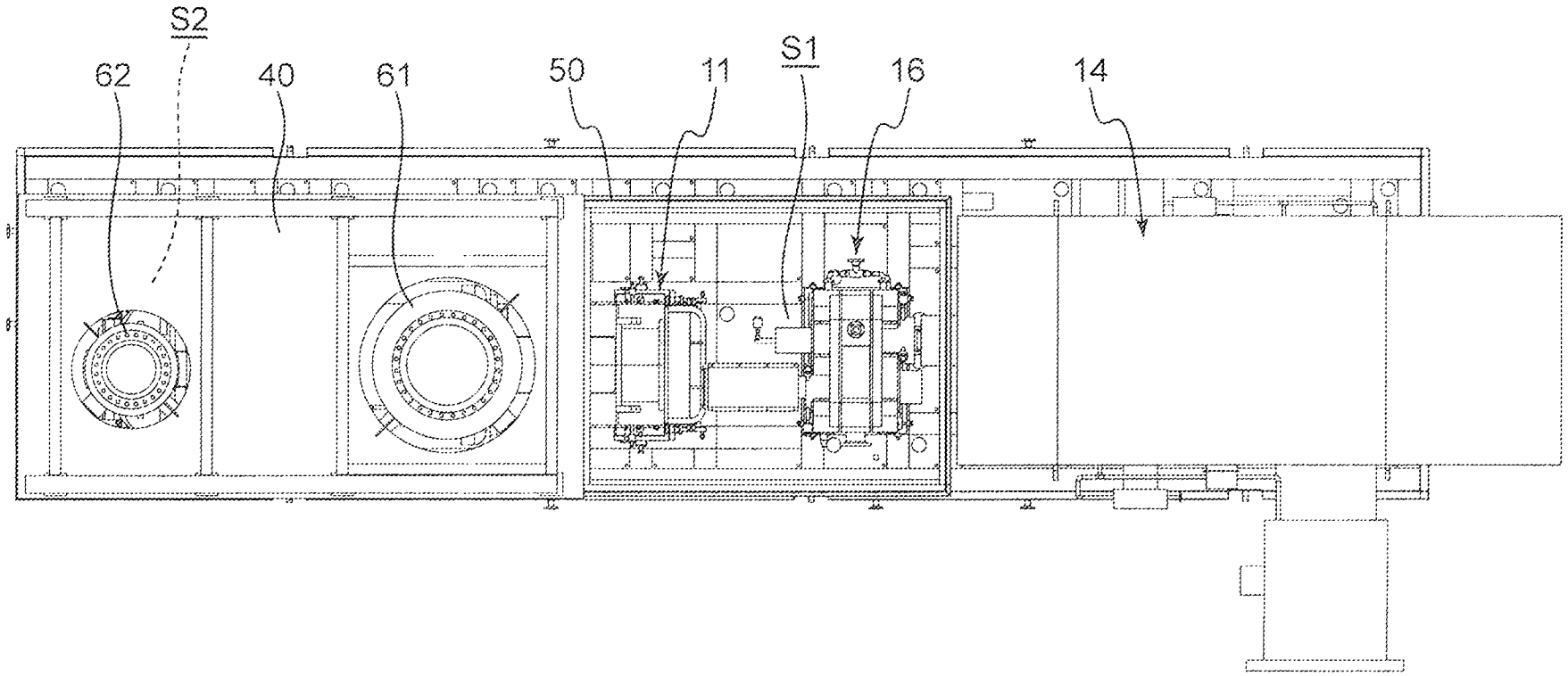
FIG. 13 is a plan view of the compressor unit.
Figure 14:
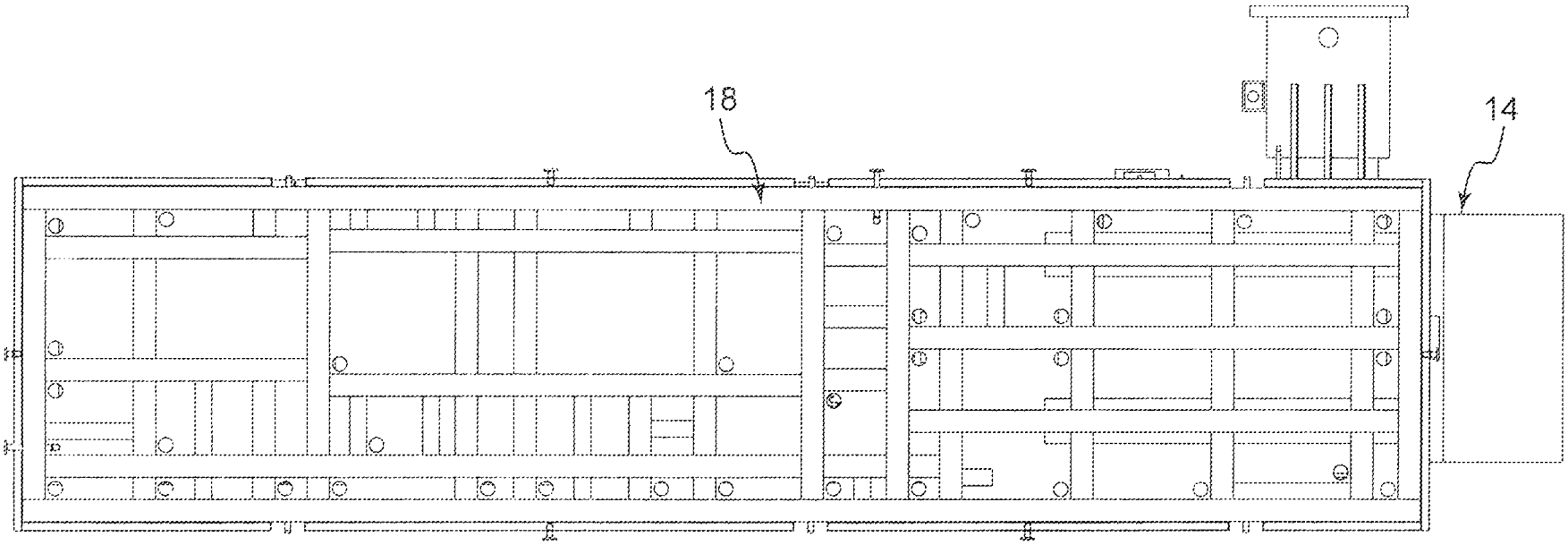
FIG. 14 is a bottom view of the compressor unit.
Figure 15:
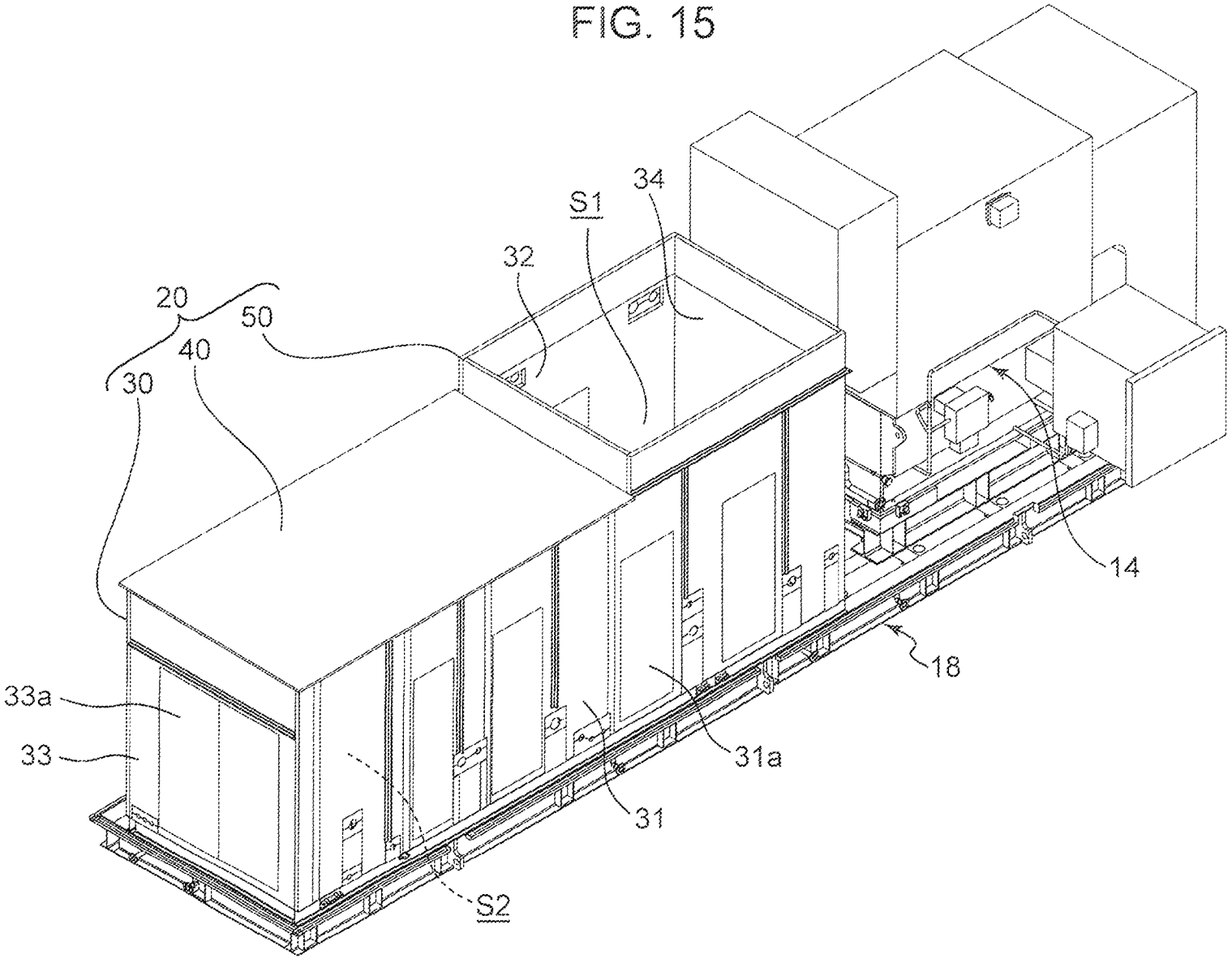
FIG. 15 is a looking-down perspective view illustrating a modified example of the compressor unit.
Figure 16:
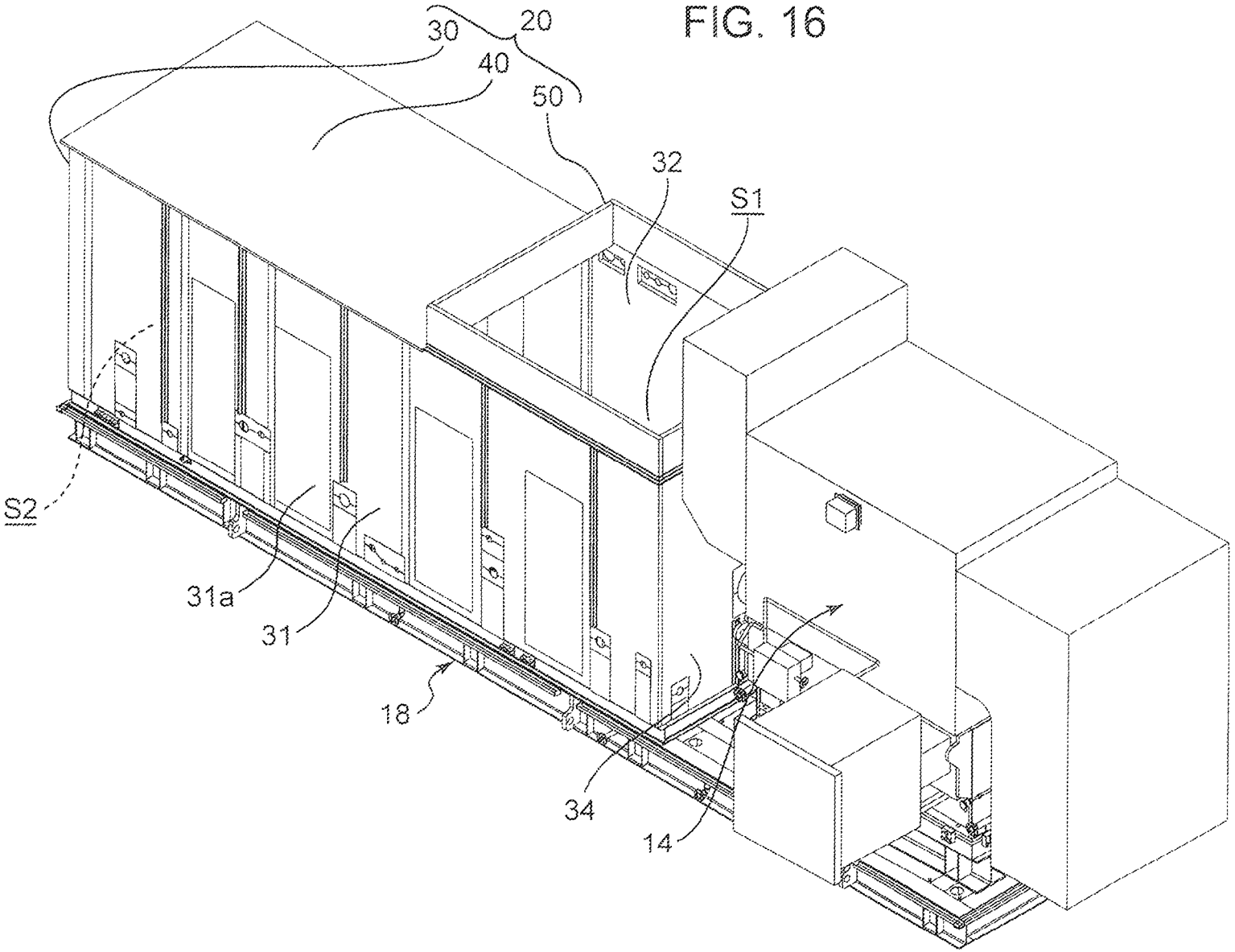
FIG. 16 is a looking-down perspective view illustrating a modified example of the compressor unit.
Figure 17:
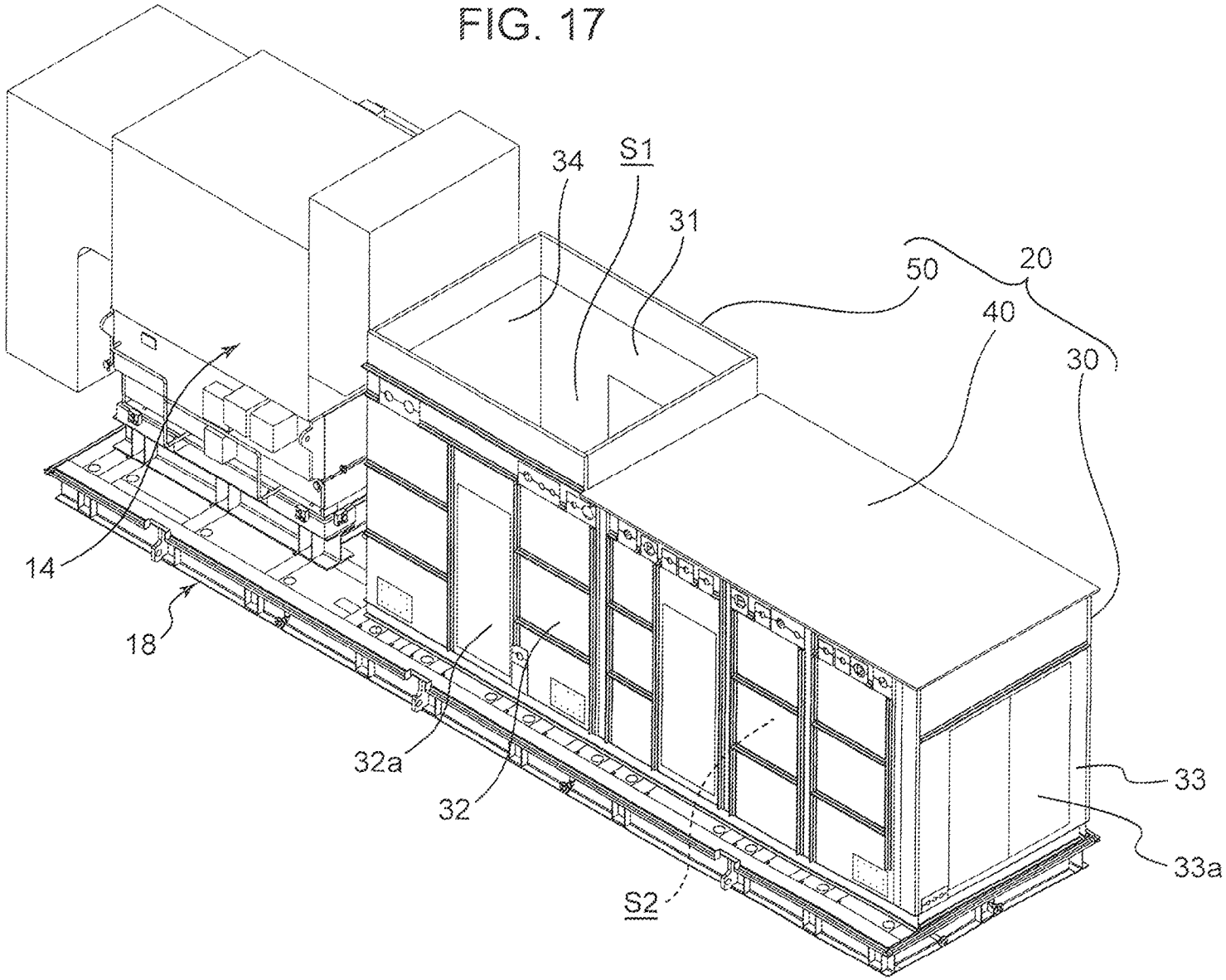
FIG. 17 is a looking-down perspective view illustrating a modified example of the compressor unit.
Figure 18:
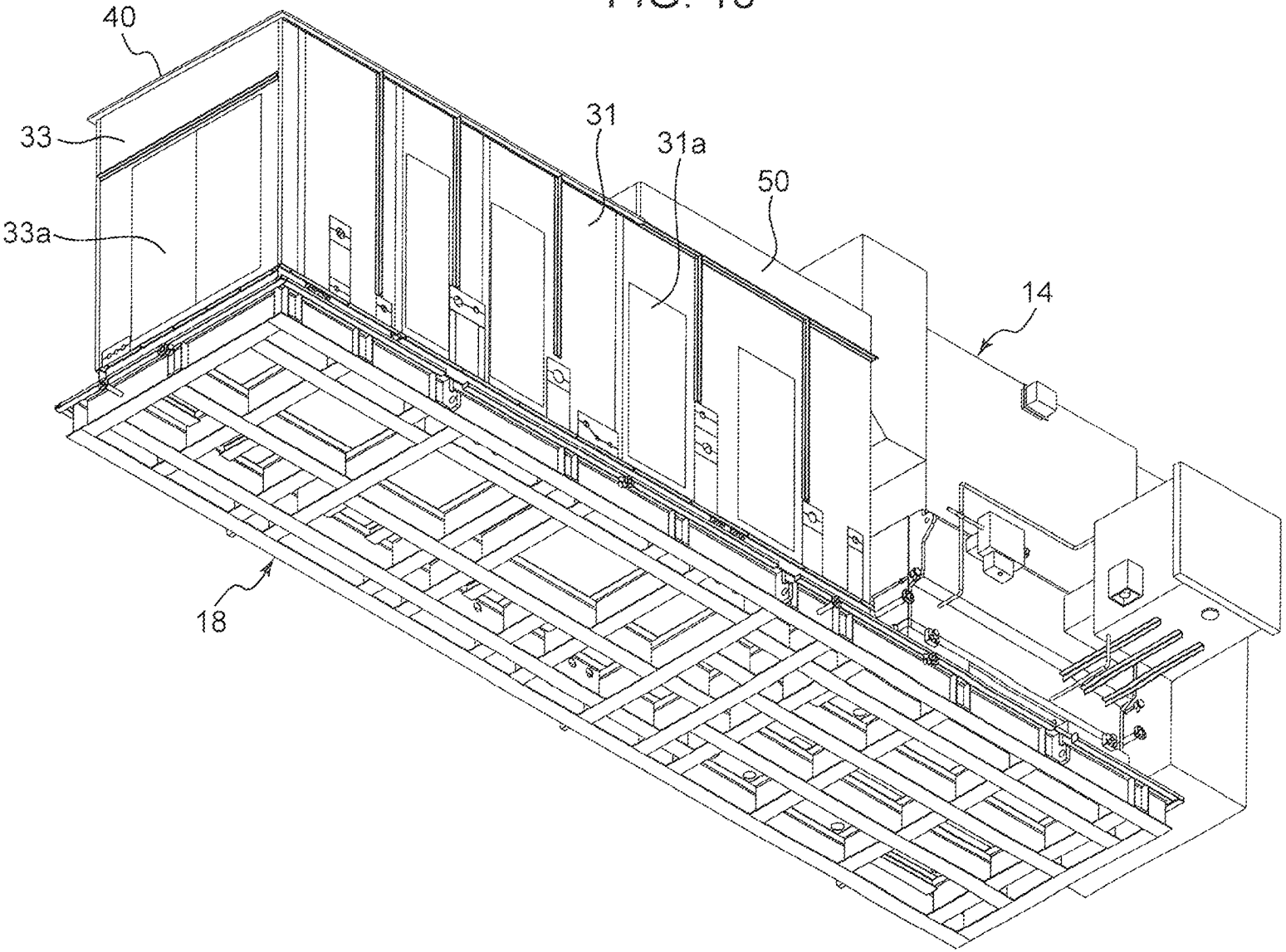
FIG. 18 is a looking-up perspective vie w illustrating a modified example of the compressor unit.
Figure 19:
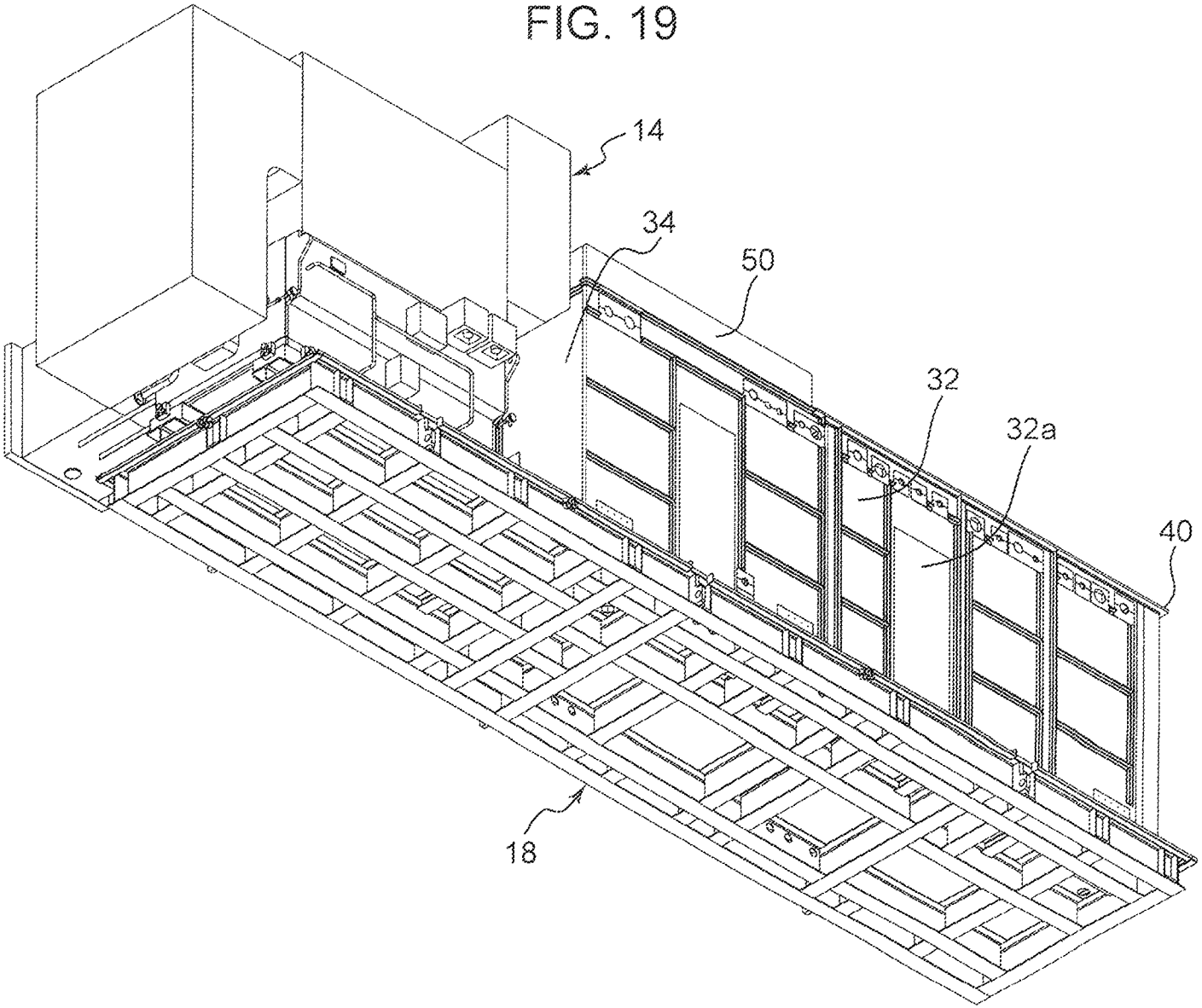
FIG. 19 is a looking-up perspective view illustrating a modified example of the compressor unit.
Figure 20:
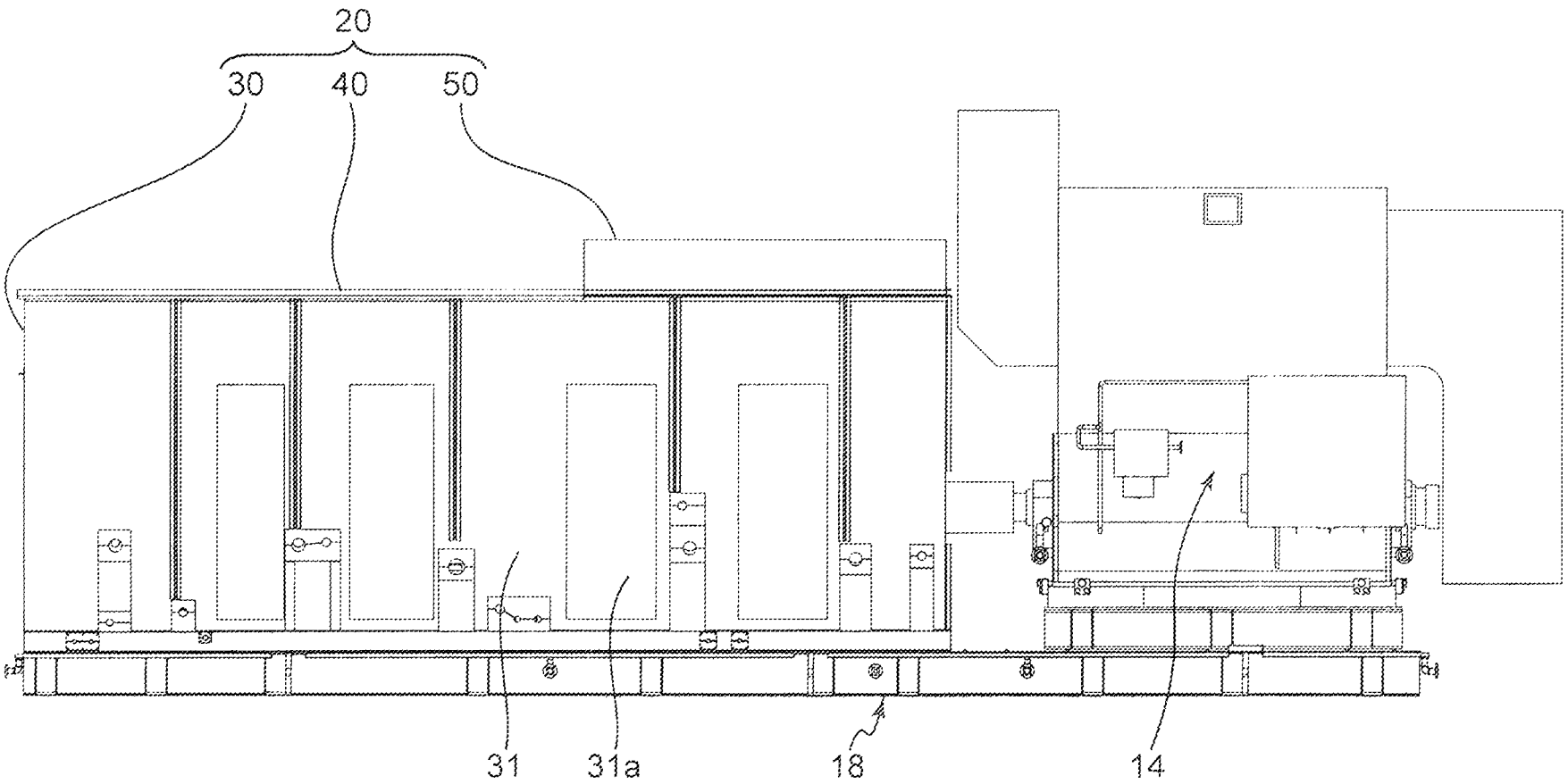
FIG. 20 is a front view of the compressor unit illustrated in FIG. 15.
Figure 21:
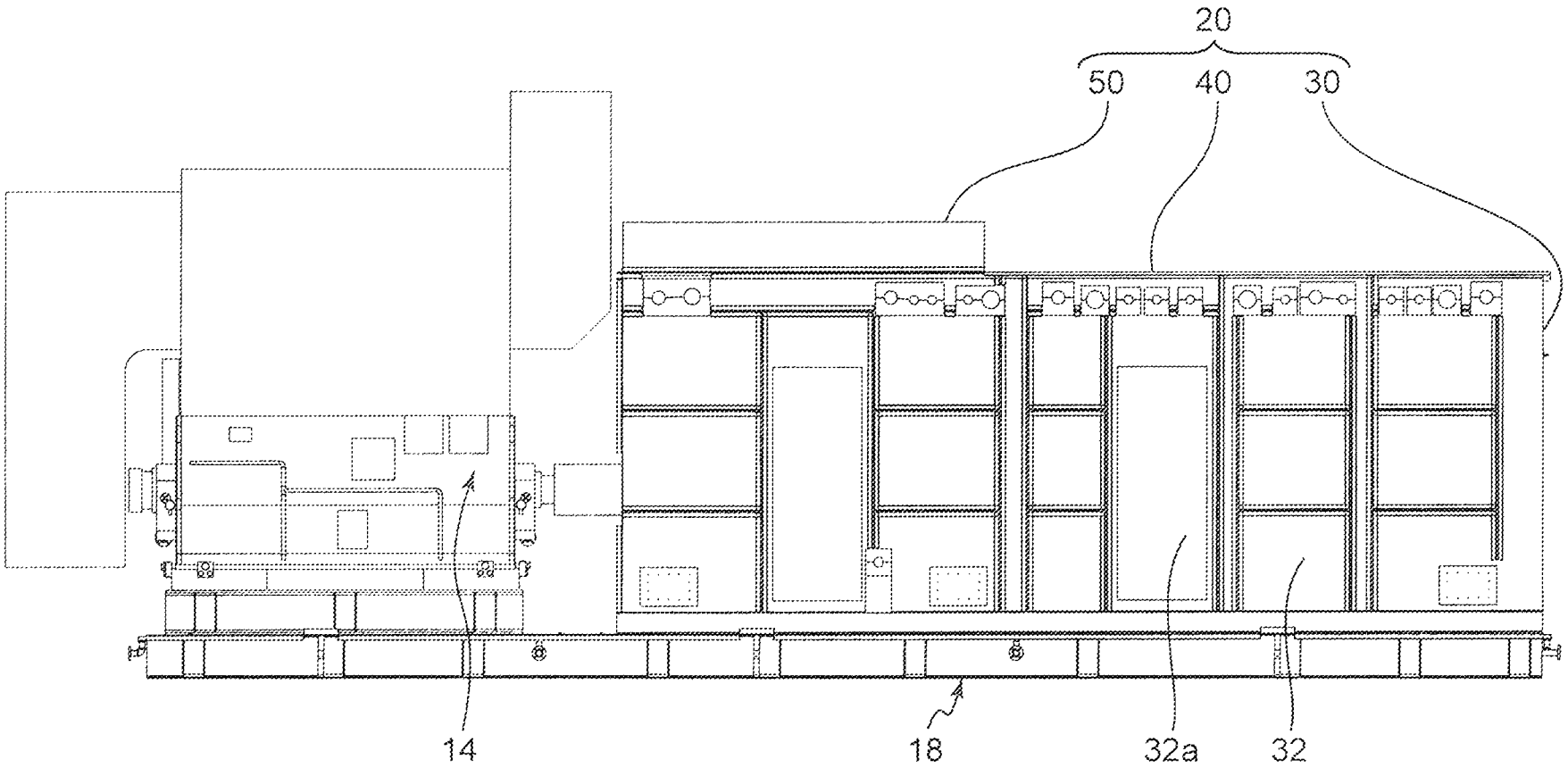
FIG. 21 is a rear view of the compressor unit illustrated in FIG. 15.
Figure 22:
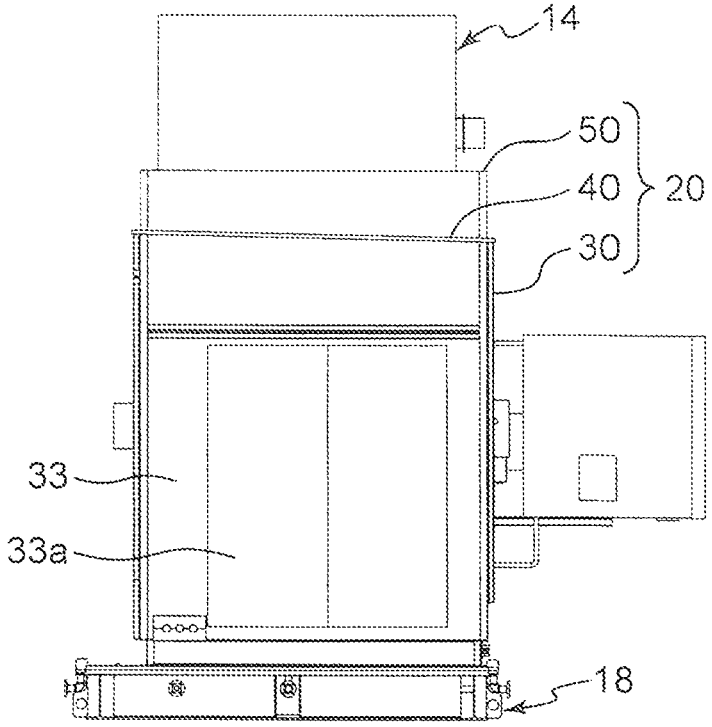
FIG. 22 is a left side view of the compressor unit illustrated in FIG. 15.
Figure 23:
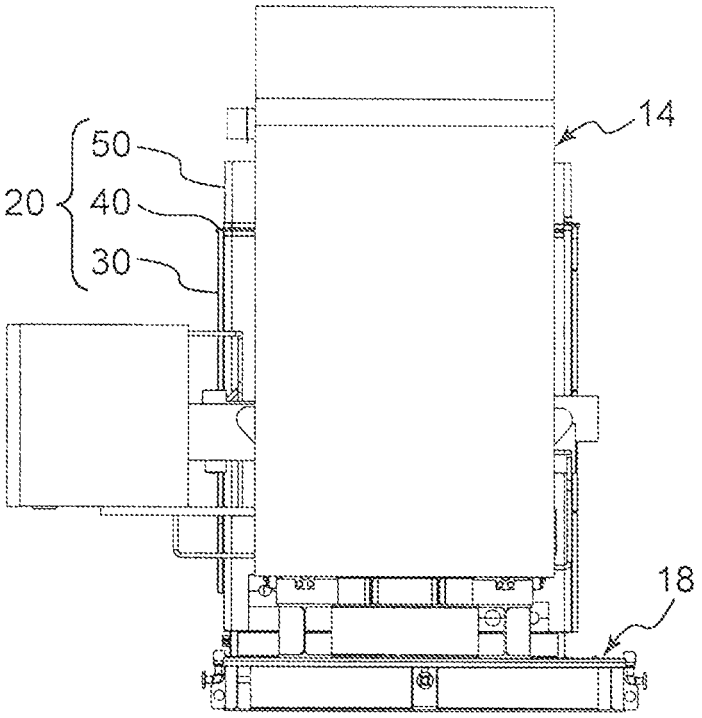
FIG. 23 is a right side view of the compressor unit illustrated in FIG. 15.
Figure 24:
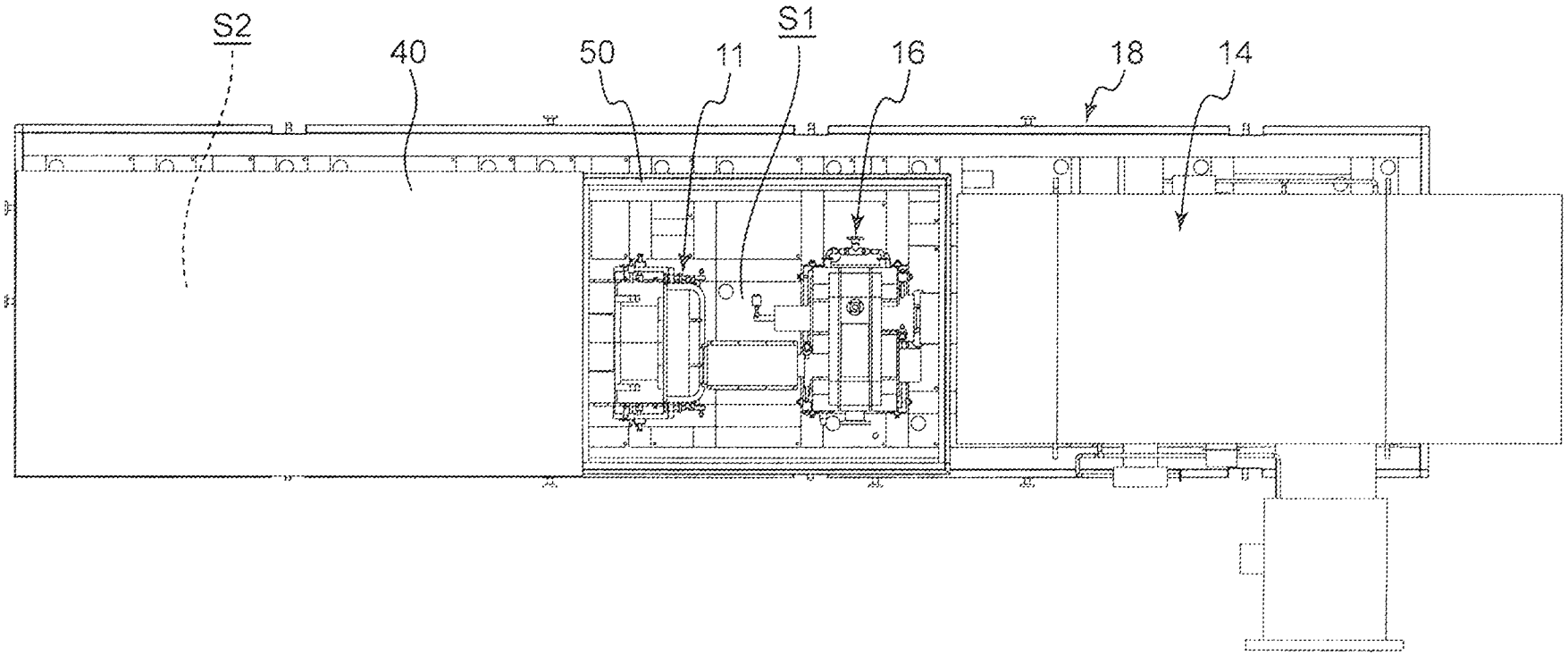
FIG. 24 is a plan view of the compressor unit illustrated in FIG. 15.
Figure 25:
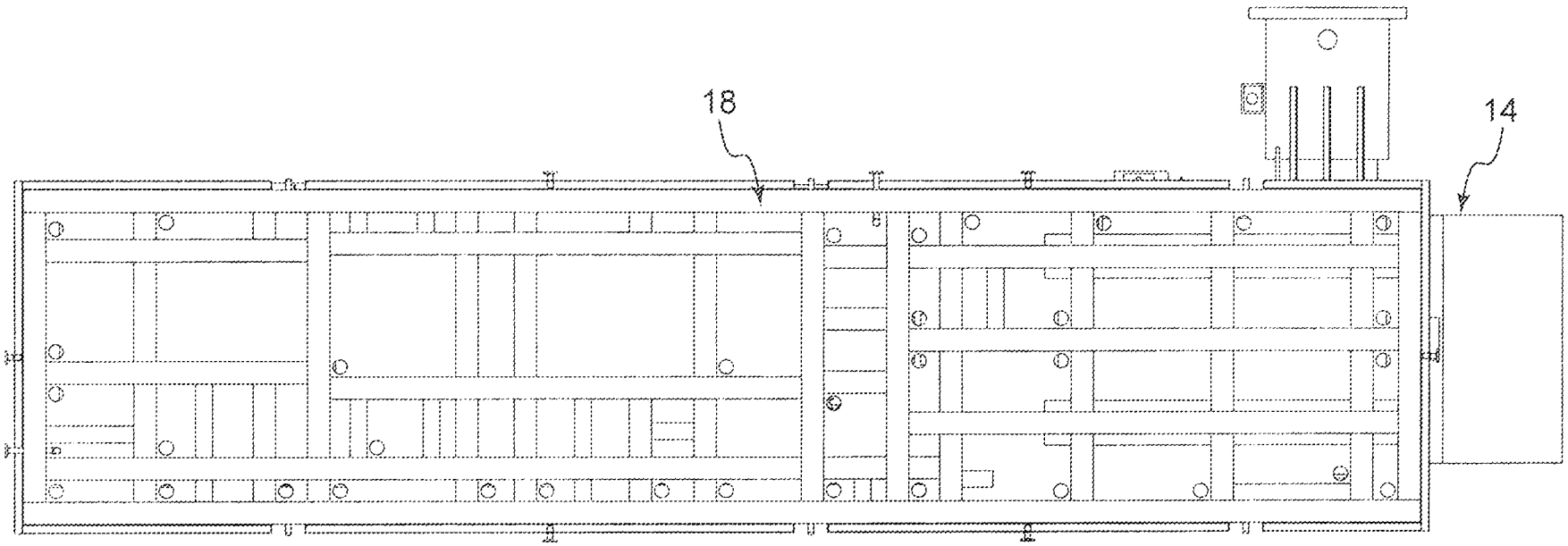
FIG. 25 is a bottom view of the compressor unit illustrated in FIG. 15.

As illustrated in FIG. 13, the electric motor 14 is disposed so as the dimension of the electric motor 14 in the lined direction to be larger than the dimension of the electric motor 14 in the depth direction. The electric motor 14 has an output shaft. This output shaft is connected to the gear box 16. The gear box 16 increases or decreases the rotational speed of the output shaft of the electric motor 14. The output shaft of the gear box 16 is connected to the first compressor 11. The output shaft of the first compressor 11 is connected to the second compressor 12. By driving the electric motor 14, the first compressor 11 and the second compressor 12 are driven. The noise generated by the first compressor 11 and the second compressor 12 is larger than the noise generated by the electric motor 14. Components of the noise generated by the compressors 11 and 12 which are directed to the electric motor 14 are reflected on the surface of the electric motor 14, That is, the electric motor 14 suppresses propagation of the noise generated by the compressors 11 and 12. In the embodiment, the first compressor 11, the second compressor 12, the electric motor 14, the gear box 16, and the sound shielding member 20 are provided on a base 18.

The sound shielding member 20 reduces the noise generated by the first compressor 11 and the second compressor 12. The sound shielding member 20 covers at least the front side, the rear side, and the left side of the circumference of the first compressor 11 and the second compressor 12 and exposes the electric motor 14. In the embodiment, the sound shielding member 20 surrounds the entire circumference of the first compressor 11 and the second compressor 12. Specifically, the sound shielding member 20 includes a side-shield part 30 surrounding the circumference of the first compressor 11 and the second compressor 12, a top-shield part 40, and a tubular-shield part 50. Each of the shield parts 30 to 50 includes a metal panel and a sound absorbing material (glass fiber or the like) joined to the back side of the metal panel. An anti-disintegration member is provided on the back side of the sound absorbing material as required to prevent disintegration of the sound absorbing material.

The side-shield part 30 surrounds the circumference of the first compressor 11, the second compressor 12 and the gear box 16. Hereinafter, a space surrounded by the side-shield part 30 is referred to as a compressor installation space. In the embodiment, the side-shield part 30 has a form of a rectangular-tubular frame. That is, the side-shield part 30 has a front side shield part 31, a rear side shield part 32, a left side shield part 33, and a right side shield part 34.

Figure 9:
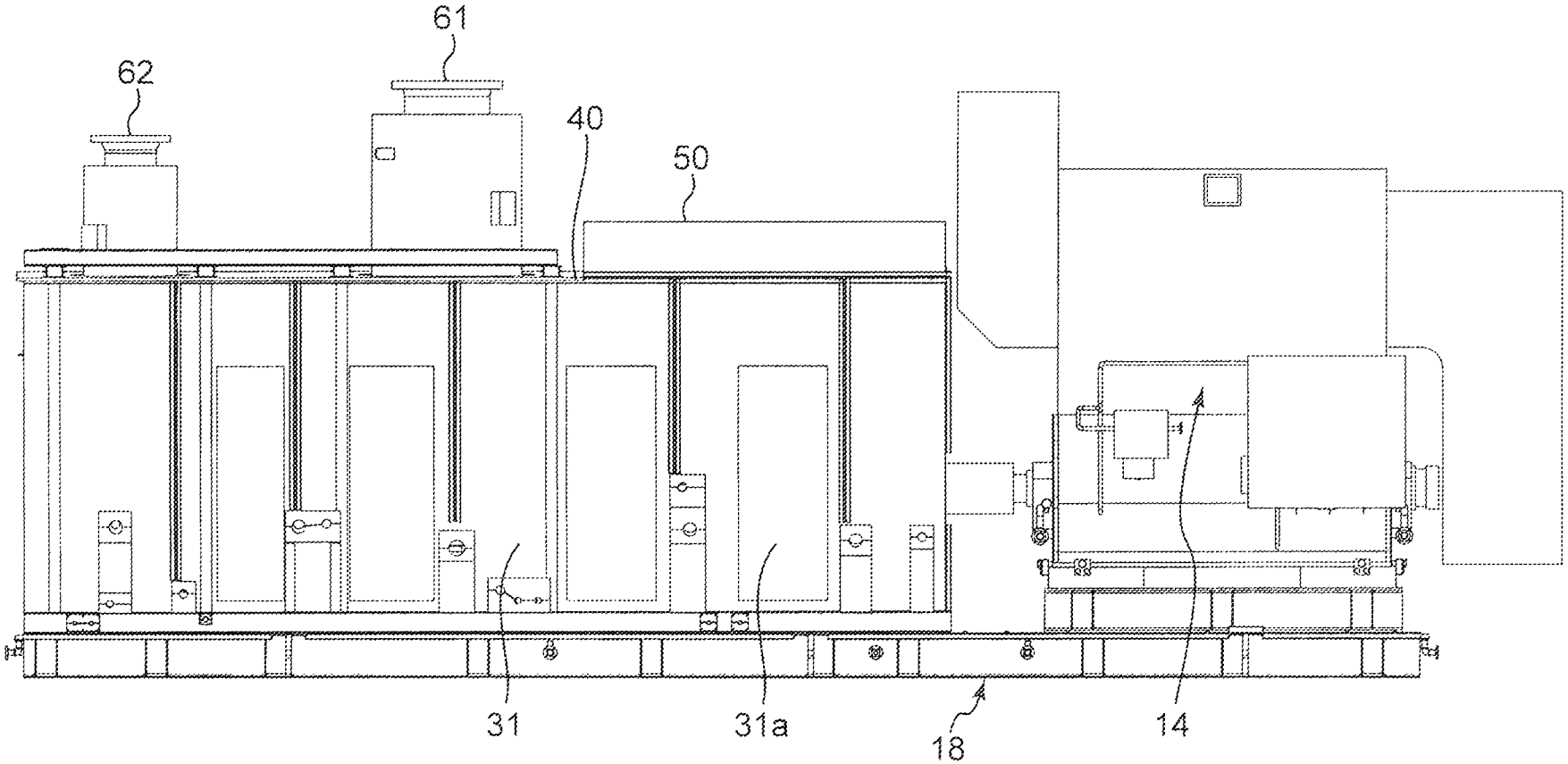
FIG. 9 is a front view of the compressor unit.

The front side shield part 31 is disposed in the front side of the compressor installation space. As illustrated in FIG. 9, the front side shield part 31 has a rectangular shape having the dimension in the lined direction larger than the dimension in the vertical direction. Specifically, the front side shield part 31 extends along the lined direction from the boundary between the gear box 16 and the electric motor 14 to the left side shield part 33. An openable door 31*a* is provided in the front side shield part 31. This door 31*a* is provided for inspecting, for example, the inner side of the sound shielding member 20.

Figure 10:
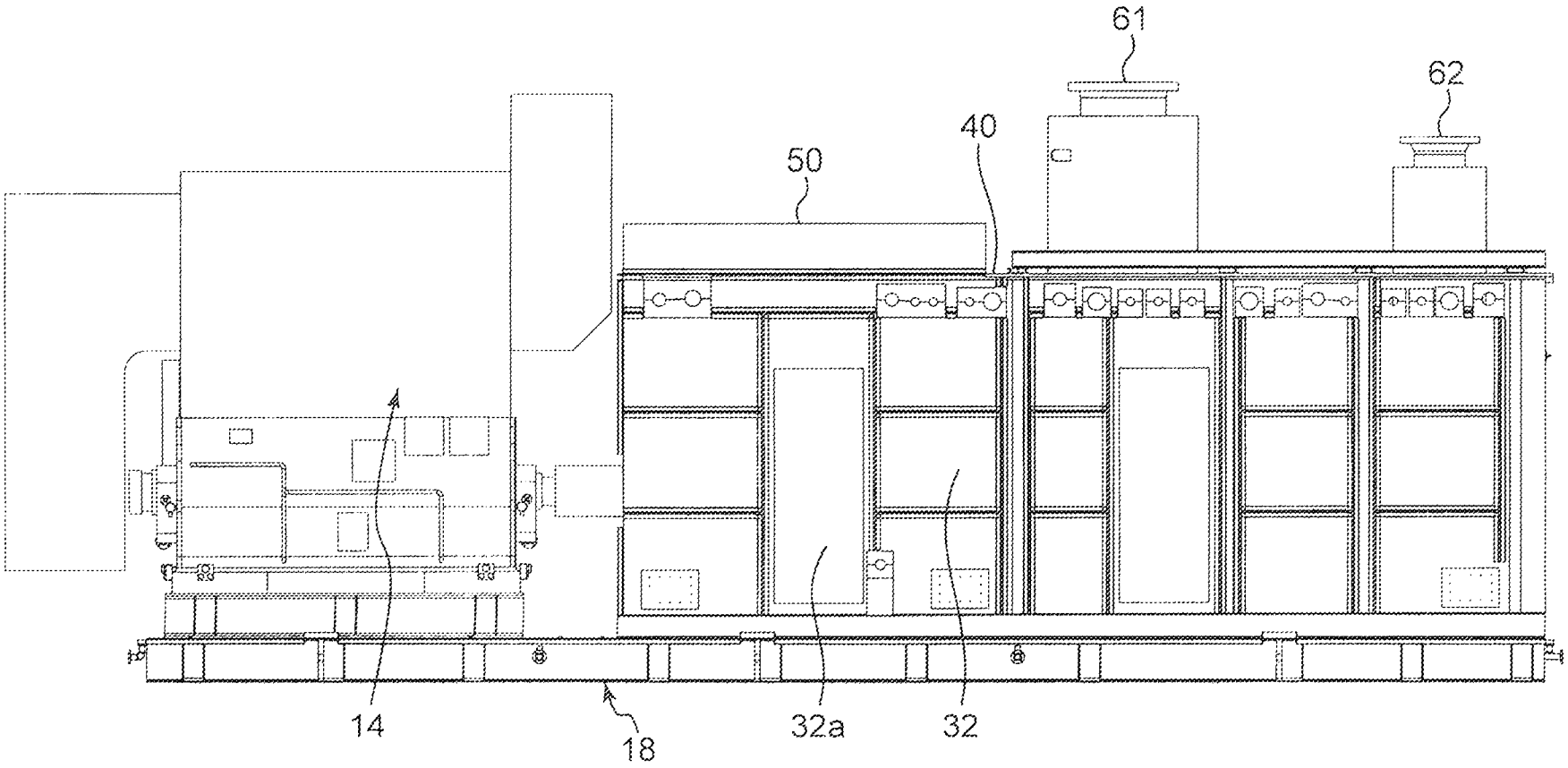
FIG. 10 is a rear view of the compressor unit.

The rear side shield part 32 is disposed in the rear side of the compressor installation space so as to be parallel to the front side shield part 31. As illustrated in FIG. 10, the rear side shield part 32 has a rectangular shape having the dimension in the lined direction larger than the dimension in the vertical direction. The rear side shield part 32 extends along the lined direction from the boundary between the gear box 16 and the electric motor 14 to the left side shield part 33. An openable door 32*a* is provided in the rear side shield part 32.

Figure 11:
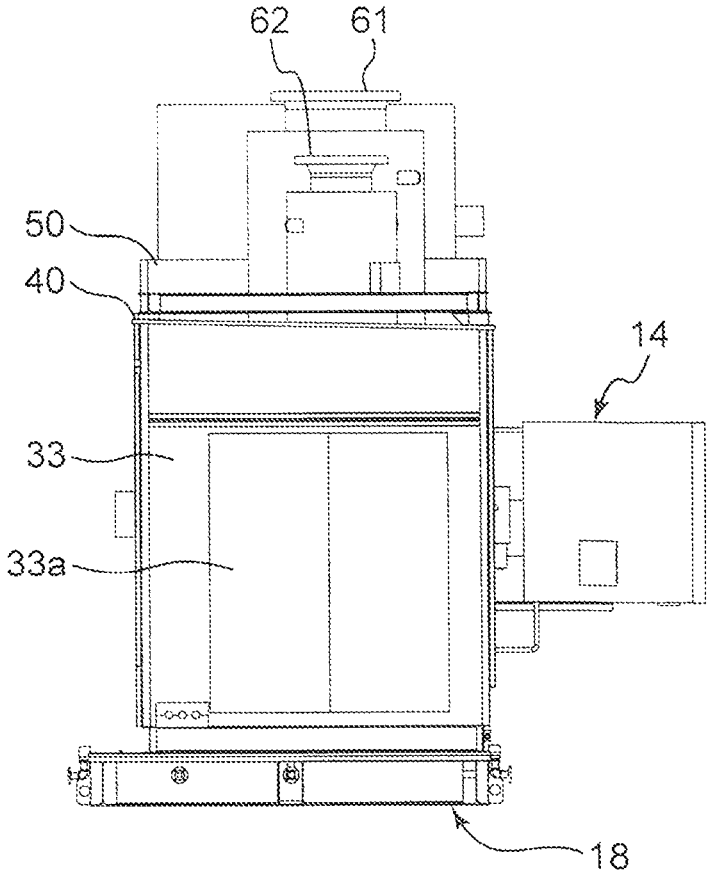
FIG. 11 is a left side view of the compressor unit.

The left side shield part 33 is disposed in the left side of the compressor installation space so as to be perpendicular to the front side shield part 31 and the rear side shield part 32. The dimension in the depth direction of the left side shield part 33 is smaller than the dimension of the front side shield part 31 in the lined direction and the dimension of the rear side shield part 32 in the lined direction. As illustrated in FIG. 11, the left side shield part 33 has a rectangular shape having the dimension in the vertical direction larger than the dimension in the depth direction. An openable door 33*a* is provided in the left side shield part 33.

Figure 12:
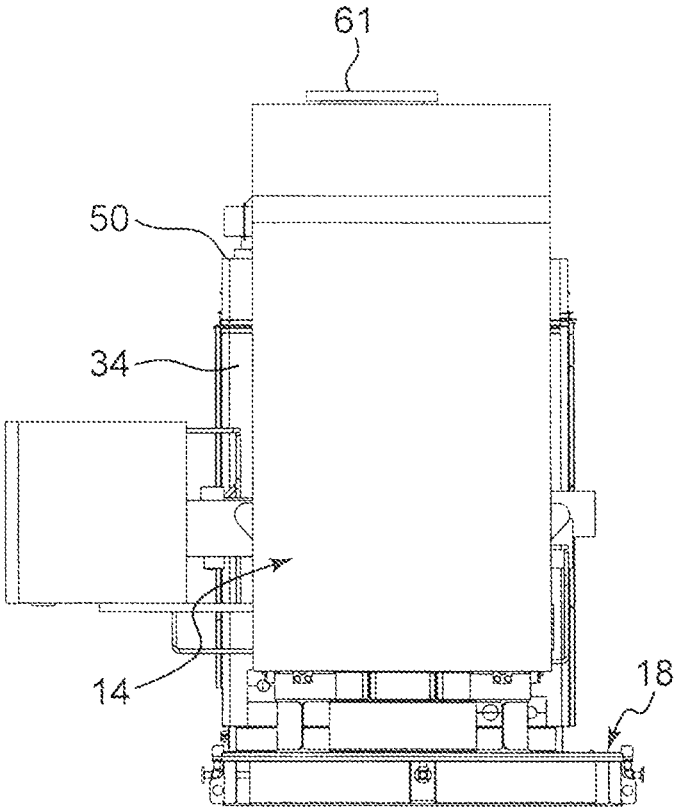
FIG. 12 is a right side view of the compressor unit.

The right side shield part 34 is disposed in the right side of the compressor installation space so as to be parallel to the left side shield part 33. The dimension of the right side shield part 34 in the depth direction is smaller than the dimension of the front side shield part 31 in the lined direction and the dimension of the rear side shield part 32 in the lined direction. As illustrated in FIG. 12, the right side shield part 34 has a rectangular shape having the dimension in the vertical direction larger than the dimension in the depth direction. A hole through which the output shaft of the electric motor 14 is inserted is formed in the right side shield part 34.

The top-shield part 40 covers from above a part of the compressor installation space surrounded by the side-shield part 30. Specifically, the top-shield part 40 opens the upper portion of a first region S1 which is close to the electric motor 14 in the lined direction in the compressor installation space and covers from above a second region S2 which is close to the left side shield part 33 in the lined direction in the compressor installation space. This configuration secures sufficient distances in the lined direction both from the first region S1 to the external of the electric motor 14 and from the first region S1 to the external of the left side shield part 33. The first region S1 in the compressor installation space is in contact with the right side shield part 34. The second region S2 in the compressor installation space is in contact with the left side shield part 33. In the embodiment, as illustrated in FIG. 13, the top-shield part 40 has a form of a rectangular shape having a dimension in the lined direction larger than the dimension in the depth direction. The dimension of the top-shield part 40 in the depth direction is larger than the distance between the front side shield part 31 and the rear side shield part 32 (the dimension in the depth direction of the left side shield part 33). The dimension of the top-shield part 40 in the lined direction is smaller than the dimension of the front side shield part 31 in the lined direction and the dimension of the rear side shield part 32 in the lined direction. The front side end of the top-shield part 40 is connected to the top end of the front side shield part 31. The back side end of the top-shield part 40 is connected to the top end of the rear side shield part 32. The left end of the top-shield part 40 is connected to the top end of the left side shield part 33. The right end of the top-shield part 40 is separated from the top end of the right side shield part. In the embodiment, the top-shield part 40 covers 50% of the compressor installation space.

In the embodiment, holes in which the first suction silencer 61 and the second suction silencer 62 are inserted are provided in the top-shield part 40. Each of the suction silencers 61 and 62 is disposed so as to project upward above the top-shield part 40. As illustrated in FIGS. 15 to 25, the suction silencers 61 and 62 may be omitted. In this case, the holes are omitted, and the top-shield part 40 is formed in a flat panel. The tubular-shield part 50 surrounds the space higher than the top-shield part 40. In the embodiment, the tubular-shield pan 50 is formed in a rectangular-tubular frame. The tubular-shield part 50 is connected to the top-shield part 40 so as the space surrounded by the tubular-shield part 50 to communicate with the first region S1 in the vertical direction. The lower left end of the tubular-shield part 50 is connected to the right end of the top-shield part 40. The front lower end of the tubular-shield part 50 is connected to the upper end of the front side shield part 31. The rear lower end of the tubular-shield part 50 is connected to the upper end of the rear side shield part 32. The right lower end of the tubular-shield part 50 is connected to the upper end of the right side shield part 34.

A driving operation of the compressor unit will be described.

First, the electric motor 14 is driven. The rotational speed of the output shall of the electric motor 14 is increased or decreased by the gear box 16 to drive the first compressor 11 and the second compressor 12. The gas flowing into the first suction silencer 61 flows into the first compressor 11 to be compressed and is then discharged. The gas discharged from the first compressor 11 flows into a first discharge silencer (not shown). The gas flowing out from the first discharge silencer flows into the second suction silencer 62 and then into the second compressor 12 to be further compressed. The gas then flows into the second discharge silencer (not shown). The compressed gas flows out of the second discharge silencer to the downstream step.

While the driven compressors 11 and 12 generate noise larger than the noise generated by the electric motor 14, the sound shielding member 20 surrounding the circumference the compressors 11 and 12 suppresses propagation of the noise generated by the compressors 11 and 12 to the circumference of the compressor unit. More specifically, the sound shielding member 20 of the embodiment surrounds the circumference of the first compressor 11 and the second compressor 12 and exposes the electric motor 14 that produces noise lower than the first compressor 11 and the second compressor 12. Thus, the amount (cost) of the sound shielding member 20 is further reduced while effectively suppressing propagation of the noise generated by the compressors 11 and 12 to the circumference of the compressor unit than covering also the circumference of the electric motor 14 with the sound shielding member.

Figure 26:
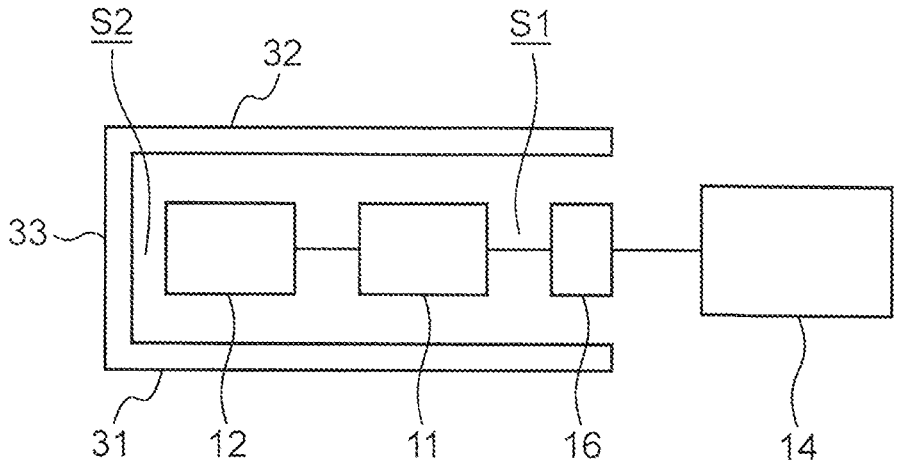
FIG. 26 is a plan view schematically illustrating a modified example of the compressor unit.

As illustrated in FIG. 26, the right side shield part 34 may be omitted, since the electric motor 14 suppresses propagation of the noise generated by the compressors 11 and 12 to the right side of the compressor installation space. In this manner, the cost can further be reduced while effectively reducing propagation of the noise generated by the compressors 11 and 12 to the circumference of the compressor unit. In other words, the embodiment illustrated in FIG. 26 uses the electric motor 14 as a part of the sound shielding structure to achieve both cost reduction and noise reduction.

In the embodiment, the top-shield part 40 covers the upper part of the second region S2 to suppress propagation of the noise from the second region S2 to the upper side. Moreover, while the upper part of the first region S1 is externally opened, sufficiently large distances in the lined direction are secured both from the first region S1 to the external of the electric motor 14 and from the first region S1 to the external of the left side shield part 33, so that the noise propagating from the upper portion of the first region S1 to the external of the electric motor 14 and to the external of the left side shield part 33 is effectively reduced. Furthermore, since the upper portion of the compressor installation space is opened, installation of fire extinguishing equipment can be omitted.

The embodiment includes the tubular-shield part 50 which extends the distance from the upper portion of the first region S1 to the circumference of the compressor unit. This further suppresses propagation of noise from the upper portion of the first region S1 to the circumference of the compressor unit.

It should be construed that the embodiments are disclosed herein by all means of illustration, not by means of limitation. The scope of the present invention is defined by the claims, not by the description on the embodiments, and includes all alterations and modifications within the scope of the meanings equivalent to the claims and within the scope of the claims.

Figure 27:
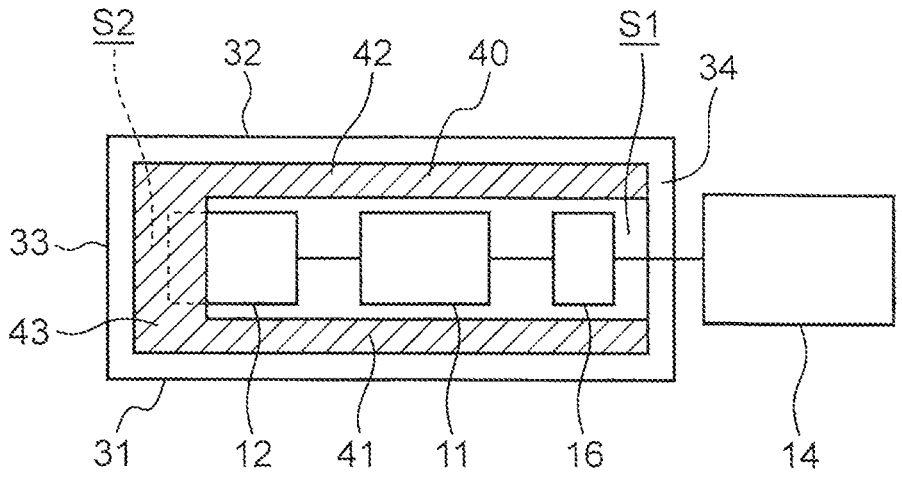
FIG. 27 is a plan view schematically illustrating, a modified example of the compressor unit.

For example, the form of the top-shield part 40 is not limited to the form in exemplary embodiments described above. The top-shield part 40 may take any form that opens the upper portion of the first region S1 and covers the second region S2 from above. For example, as illustrated in FIG. 27, the top-shield part 40 may include a front side portion 41 provided in the side to the front side shield part 31 to extend along the lined direction, a back side portion 42 provided in the side to the rear side shield part 32 to extend along the lined direction, and a left side portion 43 provided in the side to the left side shield part 33. In FIG. 27, the top-shield part 40 is indicated by hatching. The front side portion 41 and the hack side portion 42 each opens the upper portion of the first region S1, and the left side portion 43 covers the second region S2 from above. This embodiment also secures sufficient distances in the lined direction both from the first region S1 to the external of the electric motor 14 and from the first region S1 to the external of the left side shield part 33, and thus provides the same effect as the embodiment described above.

The embodiment described above will now be summarized.

A compressor unit according to the embodiment comprises a compressor, an electric motor that is disposed to be lined with the compressor along the horizontal direction and drives the compressor, and a sound shielding member that reduces noise generated by the compressor, wherein the sound shielding member has a shape of surrounding the compressor on a first side, a second side and a third side of the compressor and exposing the electric motor, the first and second sides being in a depth direction perpendicular to a lined direction in which the compressor and the electric motor are lined, and the third side being opposite to another side of the compressor where the electric motor is located in the lined direction.

In the present compressor unit, the electric motor is disposed so as to be lined with the compressor in the horizontal direction, and the sound shielding member has a shape of surrounding the compressor on the first side, the second side and the third side of the compressor the first and second sides being in the depth direction, and the third side being opposite to another side of the compressor where the electric motor is located in the lined direction. This effectively suppresses propagation of the noise generated by the compressor to the circumference of the compressor. In addition, with the sound shielding member having a shape of exposing the electric motor, the cost is further reduced than a configuration also covering the circumference of the electric motor with the sound shielding member. In other words, the compressor unit uses the electric motor as a part of the sound shielding structure, and thereby achieves both reduction in the amount (cost) of the sound shielding member and reduction in noise generated by the compressor.

Specifically, it is preferable that the sound shielding member includes a front side shield part disposed in the first side of the compressor in the depth direction, a rear side shield part disposed in the second side of the compressor in the depth direction, and a left side shield part disposed in the third side being opposite to another side o the compressor where the electric motor is located in the lined direction, the front side shield part extends in the lined direction from a boundary between the compressor and the electric motor to an end of the left side shield part, the end being in the first side of the compressor with respect to the depth direction, and the rear side shield part extends in the lined direction from the boundary between the compressor and the electric motor to an end of the left side shield part, the end being in the second side of the compressor with respect to the depth direction.

In this case, it is preferable that the sound shielding member further includes a top-shield part covering from above the compressor installation space demarcated by the front side shield part, the rear side shield part, and the left side shield part, the dimension of the front side shield part in the lined direction and the dimension of the rear side shield part in the lined direction are larger than the dimension of the left side shield part in the depth direction, and the top-shield part opens the upper portion of the first region close to the electric motor in the lined direction in the compressor installation space and covers from above the second region close to the left side shield part in the lined direction in the compressor installation space.

In such a manner, the top-shield part suppresses upward propagation of noise from the second region. Moreover, since sufficient distances in the lined direction (the longitudinal direction of the front side shield part and the rear side shield part) are secured both from the first region to the external of the electric motor and from the first region to the left side shield part, propagation of noise from the upper portion of the first region in the lined direction to the external of the electric motor and to the external of the of the left side shield part can effectively be reduced. Furthermore, since the upper portion of the compressor installation space is opened, installation of fire extinguishing equipment can be omitted.

Further, in this case, the electric motor is preferably disposed in a posture to have a larger dimension in the lined direction than the dimension in the depth direction.

Such a configuration secures a further longer distance from the second region to the external of the electric motor in the lined direction, which further suppresses propagation of noise to the external of the electric motor.

In the compressor unit, it is preferable that the sound shielding member further includes the tubular-shield part surrounding a space above the top-shield part, and that the tubular-shield part is connected to the top-shield part so as the space surrounded by the tubular-shield part to communicate with the first region in the vertical direction.

With the distance from the upper portion of the first region to the circumference of the compressor unit extended by the tubular-shield part as described above, propagation of noise from the upper portion of the first region to the circumference of the compressor unit can further be suppressed.

Further, in the compressor unit, it is preferable that the sound shielding member has a shape of surrounding the entire circumference of the compressor and exposing the electric motor.

In such a manner, both the electric motor and the sound shielding member suppress propagation of the noise generated by the compressor to the electric motor. Thus, in particular, propagation of noise to the circumference of the electric motor is effectively suppressed.

EXAMPLES

Figure 31:
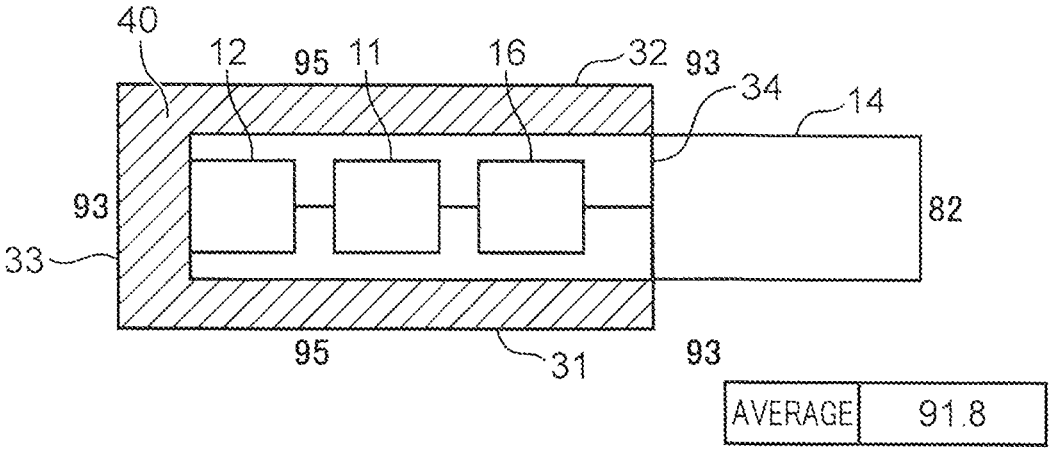
FIG. 31 is a plan view schematically illustrating an exemplary embodiment of the compressor unit.
Figure 32:
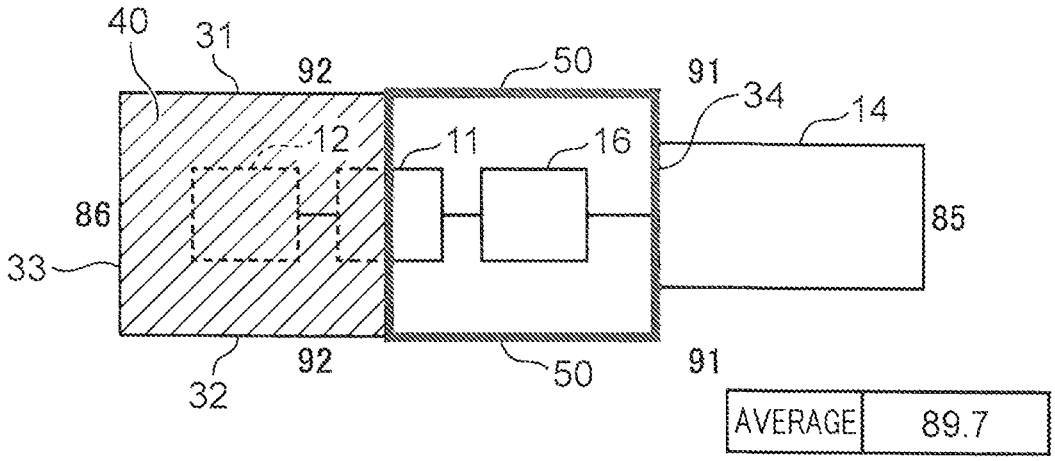
FIG. 32 is a plan view schematically illustrating an exemplary embodiment of the compressor unit.
Figure 33:
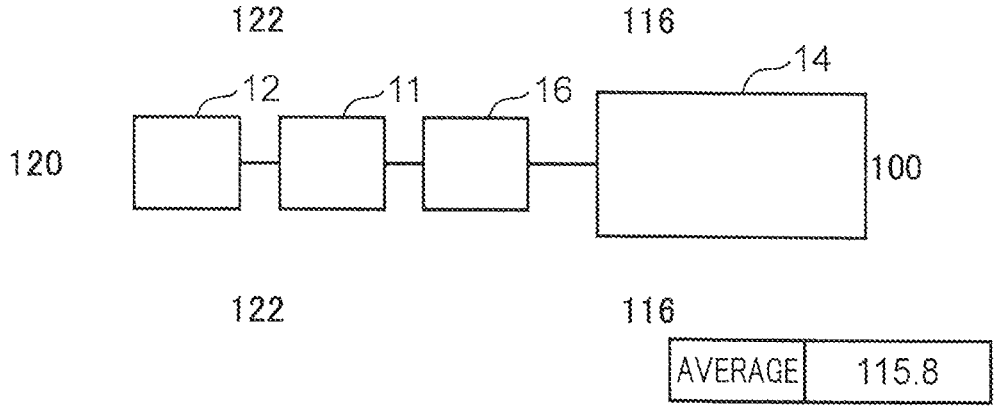
FIG. 33 is a plan view schematically illustrating a comparative example of the compressor unit.

An exemplary embodiment of the compressor unit will now be described with reference to FIGS. 28 to 33. FIG. 33 illustrates a comparative example (a compressor unit not including the sound shielding member 20). In each drawing, the noise (dBA) at a position 1 m away from the compressor unit and 1.5 m above the floor and the average of the noise are illustrated.

Figure 28:
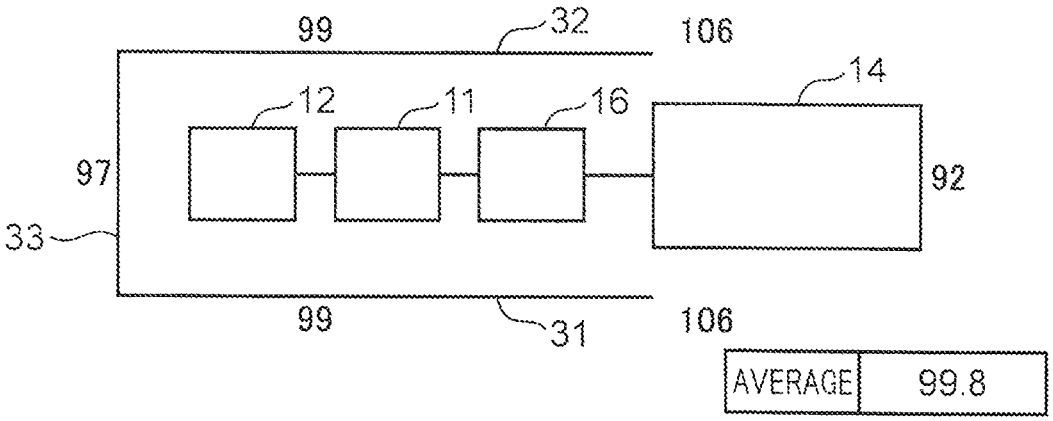
FIG. 28 is a plan view schematically illustrating an exemplary embodiment of the compressor unit.
Figure 29:
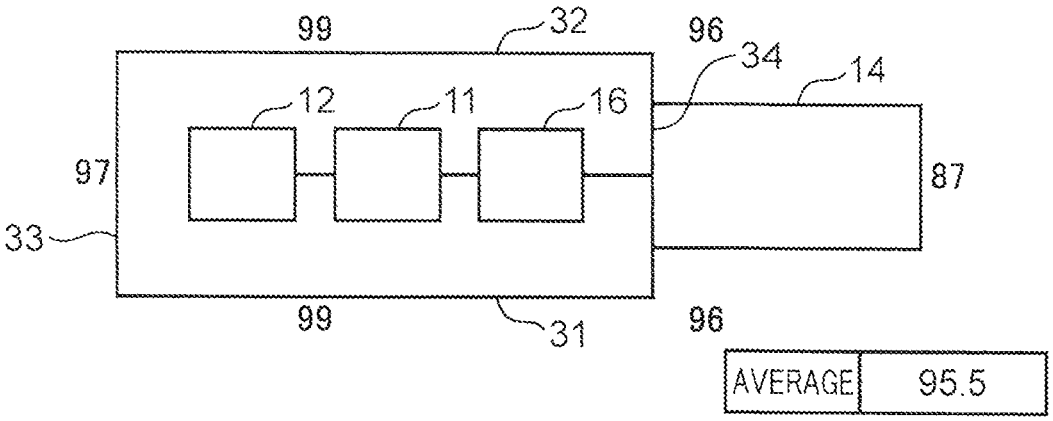
FIG. 29 is a plan view schematically illustrating an exemplary embodiment of the compressor unit.
Figure 30:
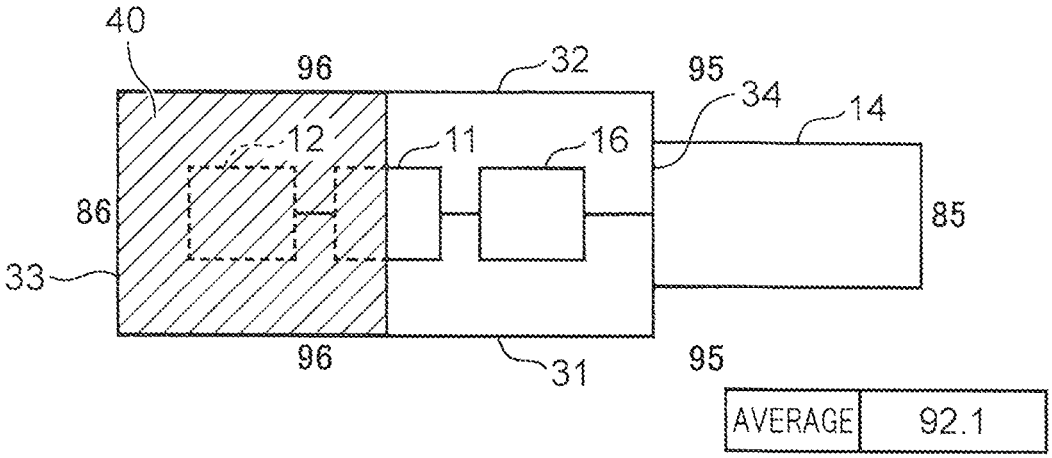
FIG. 30 is a plan view schematically illustrating an exemplary embodiment of the compressor unit.

In the exemplary embodiment illustrated in FIG. 28, the sound shielding member 20 includes only the front side shield part 31, the rear side shield part 32, and the left side shield part 33. In the exemplary embodiment illustrated in FIG. 29, the sound shielding member 20 includes only the side-shield part 30 (the front side shield part 31, the rear side shield part 32, the left side shield part 33, and the right side shield part 34). In the exemplary embodiment illustrated in FIG. 30, the sound shielding member 20 includes only the side-shield part 30 and the top-shield part 40. In the exemplary embodiment illustrated in FIG. 31, the sound shielding, member 20 includes only the side-shield part 30 and the top-shield part 40. In the exemplary embodiment illustrated in FIG. 32, the sound shielding member 20 includes a side-shield part 30, a top-shield part 40, and a tubular-shield part 50. In FIGS. 30 to 32, the top-shield part 40 is indicated by hatching. In FIG. 32, the tubular-shield part 50 is indicated by a line thicker than the lines indicating the side-shield part 30.

In the exemplary embodiments illustrated in FIGS. 28 to FIG. 32, it is understood that the noise at each position in each embodiment is further effectively reduced than the comparative example. In particular, the exemplary embodiment illustrated in FIG. 32 shows high noise reduction effect. In addition, since the top-shield part 40 covers 50% or more of the compressor installation space, further better noise reduction is achieved.

The invention claimed is:

1. A compressor unit comprising:

a compressor including a compressor casing;

an electric motor that is disposed to be aligned with the compressor along a horizontal direction and which drives the compressor;

at least one suction silencer; and a sound shielding member that reduces noise generated by the compressor, wherein the sound shielding member surrounds the compressor on a first side, a second side and a third side of the compressor and exposes the electric motor, the first and second sides being spaced apart in a depth direction perpendicular to an aligned direction in which the compressor and the electric motor are aligned, and the third side being opposite to a side of the compressor in the aligned direction where the electric motor is located, the sound shielding member includes a front side shield part disposed at the first side of the compressor, a rear side shield part disposed at the second side of the compressor, a left side shield part disposed at the third side, and a top-shield part, the front side shield part extends in the aligned direction from a boundary disposed between the compressor and the electric motor to a first end of the left side shield part in the depth direction, the rear side shield part extends in the aligned direction from the boundary disposed between the compressor and the electric motor to a second end of the left side shield part in the depth direction, the top-shield part covers from above a compressor installation space demarcated by the front side shield part, the rear side shield part, and the left side shield part, a dimension of the front side shield part in the aligned direction and a dimension of the rear side shield part in the aligned direction are both larger than a dimension of the left side shield part in the depth direction, and the top-shield part defines an opening that exposes an upper portion of a first region of the compressor installation space and covers from above a second region of the compressor installation space, the first region of the compressor installation space being positioned closer to the electric motor than the first region is to the left side shield part in the aligned direction, the second region of the compression installation space being positioned closer to the left side shield part than the second region is to the electric motor in the aligned direction, and the at least one suction silencer extending through the top-shield part at a position spaced from the opening.

2. The compressor unit according to claim 1, wherein the electric motor has a larger dimension in the aligned direction than a dimension in the depth direction.

3. The compressor unit according to claim 1, wherein the sound shielding member further includes a tubular-shield part located on the top-shield part, and the compressor installation space is open to the outside of the sound shielding member through a space surrounded by the tubular-shield part.

4. The compressor unit according to claim 1, wherein the sound shielding member surrounds an entire circumference of the compressor and exposes the electric motor.

5. A compressor unit comprising:

a compressor including a compressor casing;

a gear box;

an electric motor that is disposed to be aligned with the compressor along a horizontal direction and which drives the compressor via the gear box; and a sound shielding member that reduces noise generated by the compressor, wherein the sound shielding member surrounds the compressor on a first side, a second side and a third side of the compressor and exposes the electric motor, the first and second sides being spaced apart in a depth direction perpendicular to an aligned direction in which the compressor and the electric motor are aligned, and the third side being opposite to a side of the compressor in the aligned direction where the electric motor is located, the sound shielding member includes a front side shield part disposed at the first side of the compressor, a rear side shield part disposed at the second side of the compressor, a left side shield part disposed at the third side, and a top-shield part, the front side shield part extends in the aligned direction from a boundary disposed between the compressor and the electric motor to a first end of the left side shield part in the depth direction, the rear side shield part extends in the aligned direction from the boundary disposed between the compressor and the electric motor to a second end of the left side shield part in the depth direction, the top-shield part covers from above a compressor installation space demarcated by the front side shield part, the rear side shield part, and the left side shield part, a dimension of the front side shield part in the aligned direction and a dimension of the rear side shield part in the aligned direction are both larger than a dimension of the left side shield part in the depth direction, and the top-shield part defines a continuous opening that is directly above the compressor and the gear box and exposes an upper portion of a first region of the compressor installation space to provide a flow passage from the first region of the compressor installation space to an atmosphere external to the compressor unit, and covers from above a second region of the compressor installation space, the first region of the compressor installation space being positioned closer to the electric motor than the first region is to the left side shield part in the aligned direction, the second region of the compression installation space being positioned closer to the left side shield part than the second region is to the electric motor in the aligned direction.

6. The compressor unit according to claim 5, wherein the electric motor has a larger dimension in the aligned direction than a dimension in the depth direction.

7. The compressor unit according to claim 5, wherein the sound shielding member further includes a tubular-shield part located on the top-shield part, and the compressor installation space is open to the outside of the sound shielding member through a space surrounded by the tubular-shield part.

8. The compressor unit according to claim 5, wherein the sound shielding member surrounds an entire circumference of the compressor and exposes the electric motor.

9. A compressor unit comprising:

a compressor including a compressor casing;

an electric motor that is disposed to be aligned with the compressor along a horizontal direction and which drives the compressor; and a sound shielding member that reduces noise generated by the compressor, wherein the sound shielding member surrounds the compressor on a first side, a second side and a third side of the compressor and exposes the electric motor, the first and second sides being spaced apart in a depth direction perpendicular to an aligned direction in which the compressor and the electric motor are aligned, and the third side being opposite to a side of the compressor in the aligned direction where the electric motor is located, the sound shielding member includes a front side shield part disposed at the first side of the compressor, a rear side shield part disposed at the second side of the compressor, a left side shield part disposed at the third side, and a top-shield part, the front side shield part extends in the aligned direction from a boundary disposed between the compressor and the electric motor to a first end of the left side shield part in the depth direction, the rear side shield part extends in the aligned direction from the boundary disposed between the compressor and the electric motor to a second end of the left side shield part in the depth direction, the top-shield part covers from above a compressor installation space demarcated by the front side shield part, the rear side shield part, and the left side shield part, a dimension of the front side shield part in the aligned direction and a dimension of the rear side shield part in the aligned direction are both larger than a dimension of the left side shield part in the depth direction, and the top-shield part defines an opening that exposes an upper portion of a first region of the compressor installation space and covers from above a second region of the compressor installation space, the first region of the compressor installation space being positioned closer to the electric motor than the first region is to the left side shield part in the aligned direction, the second region of the compressor installation space being positioned closer to left side shield part than the second region is to the electric motor in the aligned direction, the first region of the compressor installation space being open to create a passage to an atmosphere external to the compressor unit through the opening in the sound shielding member.

10. The compressor unit according to claim 9, wherein the electric motor has a larger dimension in the aligned direction than a dimension in the depth direction.

11. The compressor unit according to claim 9, wherein the sound shielding member further includes a tubular-shield part located on the top-shield part, and the compressor installation space is open to the outside of the sound shielding member through a space surrounded by the tubular-shield part.

12. The compressor unit according to claim 9, wherein the sound shielding member surrounds an entire circumference of the compressor and exposes the electric motor.

* * * * *